US012241378B2

(12) United States Patent
Tian et al.

(10) Patent No.: US 12,241,378 B2
(45) Date of Patent: Mar. 4, 2025

(54) GAS TURBINE OVERSPEED PROTECTION METHOD AND APPARATUS, ELECTRONIC DEVICE AND STORAGE MEDIUM

(71) Applicant: YANTAI JEREH PETROLEUM EQUIPMENT & TECHNOLOGIES CO., LTD., Shandong (CN)

(72) Inventors: Dekun Tian, Shandong (CN); Tao Kou, Shandong (CN); Wanchun Cha, Shandong (CN); Zhijie Liu, Shandong (CN); Xin Li, Shandong (CN); Jianglei Zou, Shandong (CN); Libin Zhou, Shandong (CN); Xu Liu, Shandong (CN); Zhuqing Mao, Shandong (CN); Rikui Zhang, Shandong (CN); Peng Zhang, Shandong (CN); Jianwei Wang, Shandong (CN); Jihua Wang, Shandong (CN); Xiaolei Ji, Shandong (CN); Xincheng Li, Shandong (CN); Yuxuan Sun, Shandong (CN); Yipeng Wu, Shandong (CN); Chunqiang Lan, Shandong (CN); Liang Lv, Shandong (CN)

(73) Assignee: YANTAI JEREH PETROLEUM EQUIPMENT & TECHNOLOGIES CO., LTD., Yantai (CN)

( * ) Notice: Subject to any disclaimer, the term of this patent is extended or adjusted under 35 U.S.C. 154(b) by 0 days.

(21) Appl. No.: 18/353,342

(22) Filed: Jul. 17, 2023

(65) Prior Publication Data

US 2023/0358127 A1 Nov. 9, 2023

Related U.S. Application Data

(63) Continuation-in-part of application No. 18/066,630, filed on Dec. 15, 2022, now Pat. No. 11,739,622, and (Continued)

(30) Foreign Application Priority Data

Jan. 26, 2021 (CN) ..... 202110101567.8
Jun. 1, 2021 (CN) ..... 202110608526.8
Nov. 17, 2021 (CN) ..... 202111363408.1

(51) Int. Cl.
*F01D 21/02* (2006.01)
*F01D 15/08* (2006.01)

(Continued)

(52) U.S. Cl.
CPC ..... *F01D 21/02* (2013.01); *F01D 15/08* (2013.01); *F01D 15/12* (2013.01); *F01D 17/06* (2013.01);

(Continued)

(58) Field of Classification Search
CPC ..... F01D 17/04; F01D 17/06; F01D 17/105; F01D 19/00; F01D 21/003; F01D 21/02;

(Continued)

(56) References Cited

U.S. PATENT DOCUMENTS 4,406,117 A * 9/1983 Rowen ..... F02C 9/54 60/39.27
6,230,479 B1 5/2001 Kawamura et al.

(Continued)

FOREIGN PATENT DOCUMENTS

CN 2099912 U 3/1992
CN 1112190 A 11/1995

(Continued)

OTHER PUBLICATIONS

Notice of Allowance for U.S. Appl. No. 18/066,630 mailed on Apr. 10, 2023.

(Continued)

*Primary Examiner* — Kyle Robert Thomas
(74) *Attorney, Agent, or Firm* — Sheppard Mullin Richter & Hampton LLP

(57) ABSTRACT

A gas turbine overspeed protection method includes: a power utilization load of a generator is acquired, and a rotating speed value of a gas turbine is acquired; whether the power utilization load suddenly decreases or disappears is judged, and if so, an eddy current retarder is controlled by a controller to simulate the power utilization load to provide a braking torque for the generator; or, whether the rotating speed value exceeds a set speed range is judged, and if so, the gas turbine is controlled by the controller to reduce fuel supply, and a discharge valve of a gas compressor is opened to discharge a high-pressure gas to reduce the power output and the rotating speed of the gas turbine.

19 Claims, 17 Drawing Sheets

Related U.S. Application Data a continuation-in-part of application No. PCT/CN2021/135089, filed on Dec. 2, 2021, said application No. 18/066,630 is a continuation of application No. 17/485,014, filed on Sep. 24, 2021, now Pat. No. 11,560,779, which is a continuation-in-part of application No. 17/172,819, filed on Feb. 10, 2021, now Pat. No. 11,143,006.

(51) Int. Cl.

| | |
|---|---|
| ***F01D 15/12*** | (2006.01) |
| ***F01D 17/06*** | (2006.01) |
| ***F01D 17/10*** | (2006.01) |
| ***F01D 19/00*** | (2006.01) |
| ***F01D 21/00*** | (2006.01) |
| ***F04B 17/05*** | (2006.01) |
| ***F04B 49/02*** | (2006.01) |
| ***F04B 49/06*** | (2006.01) |
| *E21B 43/26* | (2006.01) |

(52) U.S. Cl.

CPC ..... *F01D 17/105* (2013.01); *F01D 19/00* (2013.01); *F01D 21/003* (2013.01); *F01D 21/006* (2013.01); *F04B 17/05* (2013.01); *F04B 49/02* (2013.01); *F04B 49/065* (2013.01); *E21B 43/2607* (2020.05)

(58) Field of Classification Search

CPC ..... F01D 21/006; F01D 15/08; F01D 15/12; F04B 17/05; F04B 49/02; F04B 49/065; E21B 43/2607

See application file for complete search history.

(56) References Cited

U.S. PATENT DOCUMENTS

| | | | | |
|---|---|---|---|---|
| 9,601,918 | B2 * | 3/2017 | Panosyan | H02J 3/42 |
| 9,689,316 | B1 * | 6/2017 | Crom | F02C 9/26 |
| 10,400,858 | B2 * | 9/2019 | Mitrovic | F16H 1/20 |
| 10,407,990 | B2 | 9/2019 | Oehring et al. | |
| 10,865,624 | B1 | 12/2020 | Cui et al. | |
| 10,865,631 | B1 | 12/2020 | Zhang et al. | |
| 10,914,155 | B2 | 2/2021 | Oehring et al. | |
| 10,954,855 | B1 | 3/2021 | Ji et al. | |
| 10,961,993 | B1 | 3/2021 | Ji et al. | |
| 11,143,006 | B1 | 10/2021 | Zhang et al. | |
| 11,242,737 | B2 | 2/2022 | Zhang et al. | |
| 11,255,173 | B2 | 2/2022 | Coli et al. | |
| 11,359,462 | B2 | 6/2022 | Morris et al. | |
| 11,391,136 | B2 | 7/2022 | Coli et al. | |
| 11,408,417 | B1 | 8/2022 | Stephenson et al. | |
| 2006/0150633 | A1 | 7/2006 | Mcginley et al. | |
| 2012/0191322 | A1 | 7/2012 | Garrard | |
| 2014/0048268 | A1 | 2/2014 | Chandler | |
| 2018/0266412 | A1 | 9/2018 | Stokkevåg et al. | |
| 2019/0052206 | A1 | 2/2019 | Noderer | |
| 2020/0003205 | A1 | 1/2020 | Stokkevåg et al. | |
| 2020/0109616 | A1 | 4/2020 | Oehring et al. | |
| 2020/0206651 | A1 | 7/2020 | Frick | |
| 2020/0332784 | A1 | 10/2020 | Zhang et al. | |
| 2020/0340344 | A1 | 10/2020 | Reckels et al. | |
| 2020/0400005 | A1 | 12/2020 | Han et al. | |
| 2021/0071579 | A1 | 3/2021 | Li et al. | |
| 2021/0071752 | A1 | 3/2021 | Cui et al. | |
| 2021/0086851 | A1 | 3/2021 | Zhang et al. | |
| 2021/0087883 | A1 | 3/2021 | Zhang et al. | |
| 2021/0087916 | A1 | 3/2021 | Zhang et al. | |
| 2021/0088042 | A1 | 3/2021 | Zhang et al. | |
| 2021/0126561 | A1 | 4/2021 | Shampine | |
| 2021/0396122 | A1 | 12/2021 | Yeung et al. | |
| 2022/0127944 | A1 | 4/2022 | Chapman et al. | |
| 2022/0235640 | A1 | 7/2022 | Mao et al. | |

FOREIGN PATENT DOCUMENTS

| | | | |
|---|---|---|---|
| CN | 101268266 | A | 9/2008 |
| CN | 201184667 | Y | 1/2009 |
| CN | 201273266 | Y | 7/2009 |
| CN | 101706662 | A | 5/2010 |
| CN | 102287360 | A | 12/2011 |
| CN | 102602323 | A | 7/2012 |
| CN | 102606330 | A | 7/2012 |
| CN | 202413454 | U | 9/2012 |
| CN | 103558031 | A | 2/2014 |
| CN | 204436358 | U | 7/2015 |
| CN | 205779233 | U | 12/2016 |
| CN | 108026788 | A | 5/2018 |
| CN | 207752603 | U | 8/2018 |
| CN | 109882144 | A | 6/2019 |
| CN | 110005085 | A | 7/2019 |
| CN | 110050107 | A | 7/2019 |
| CN | 110454285 | A | 11/2019 |
| CN | 110469654 | A | 11/2019 |
| CN | 110485983 | A | 11/2019 |
| CN | 211144459 | U | 7/2020 |
| CN | 212202250 | U | 12/2020 |
| CN | 112202274 | A | 1/2021 |
| CN | 112780245 | A | 5/2021 |
| CN | 112879168 | A | 6/2021 |
| CN | 215057294 | U | 12/2021 |
| EP | 2848772 | A1 | 3/2015 |

OTHER PUBLICATIONS

Written Opinion and International Search Report for International Application No. PCT/CN2021/135089 mailed on Jul. 29, 2022.

First Search for Chinese Application No. 202111363408.1 mailed on Apr. 11, 2023.

Wang et al., "The control strategy of shipps gas turbine power2generating module," Ship Science and Technology, vol. 32, No. 8, Aug. 15, 2020.

Li et al., "Study on the Theory and Application of Electric Eddy Retarder," Tractor & Farm Transporter, vol. 33, No. 1, Feb. 2006.

First Search for Chinese Application No. 202110608526.8 mailed on May 20, 2022.

Search Report for Chinese Application No. 202110608526.8 mailed on Dec. 8, 2022.

First Office Action for Chinese Application No. 202110101567.8 mailed on Aug. 29, 2024. English Machine Translation provided.

First Search Report for Chinese Application No. 202110101567.8 mailed on Aug. 19, 2024. English Machine Translation provided.

Zhang et al., "Application Evaluation and Technology Development Prospect of Fracturing Equipment", Drilling & Production Technology, Mar. 25, 2020. English Abstract provided.

Cheng et al., "Fire Control Engineering", China University of Mining and Technology Press, May 31, 2002. English machine translation provided.

(56) References Cited

OTHER PUBLICATIONS

Second Office Action for Chinese Application No. 202110101567.8 mailed on Dec. 13, 2024.

* cited by examiner

GAS TURBINE OVERSPEED PROTECTION METHOD AND APPARATUS, ELECTRONIC DEVICE AND STORAGE MEDIUM

CROSS-REFERENCE TO RELATED APPLICATIONS

The present application is a continuation-in-part application of International Application No. PCT/CN2021/135089 filed on Dec. 2, 2021, which claims priority to Chinese Patent Application No. 202111363408.1 filed on Nov. 17, 2021. The present application is also a continuation-in-part application of U.S. patent application Ser. No. 18/066,630 filed on Dec. 15, 2022, which is a continuation application of U.S. patent application Ser. No. 17/485,014 filed on Sep. 24, 2021, now issued as U.S. Pat. No. 11,560,779, which is a continuation-in-part application of U.S. patent application Ser. No. 17/172,819 filed on Feb. 10, 2021 now issued as U.S. Pat. No. 11,143,006, which claims priority to Chinese Patent Application No. 202110101567.8, filed on Jan. 26, 2021. U.S. patent application Ser. No. 17/485,014 claims priority to Chinese Patent Application No. 202110608526.8 filed on Jun. 1, 2021. The entire contents of all of the above-identified applications are incorporated herein by reference in their entirety.

TECHNICAL FIELD

The present disclosure relates to the technical field of safety monitoring of gas turbines, and in particular, to a gas turbine overspeed protection method and apparatus, an electronic device and a computer-readable storage medium.

BACKGROUND

A gas turbine generator set has the advantages of large output power, high energy density, low noise, low emission and the like, but the gas turbine generator set faces a difficult problem of overspeed of the gas turbine. At present, if the load of the gas turbine generator set suddenly disappears during normal operation, and if a generator occurs sudden load shedding, the rotating speeds of the gas turbine and the generator will suddenly rise. For a light-duty gas turbine, when the rotating speed exceeds about 5% of a set rated value of the gas turbine, the gas turbine may aborts, and if the rotating speed exceeds a maximum allowable rotating speed of the gas turbine, the gas turbine will be damaged. Large gas turbines and steam turbines also have the same problem, and once damaged they need to be returned to the factories for maintenance and repair. Likewise, the generator also faces the risk of generator overspeed. The current solution is to prevent the overspeed of the gas turbine by means of reducing the fuel supply of the gas turbine, controlling the opening and closing of a discharge valve on the gas turbine, discharging a high-pressure gas from a gas compressor to reduce air supply, or discharging a high-pressure and high-temperature gas from the inlet of a power turbine to reduce power input.

However, this method has many disadvantages, for example, the discharge of the high-pressure and high-temperature gas is difficult, the reduction of the fuel and the discharge of the high-pressure gas have hysteresis, and the overspeed of the gas turbine cannot be well prevented after the generator set is subjected to load shedding. Moreover, the whole shafting of the generator set has very large inertia, especially when the load of a heavy generator set suddenly decreases or disappears, the rotating speed suddenly rises under the action of an inertia force, and the rotating speed cannot be effectively stabilized in time just by reducing the rotating speed and the power of the gas turbine. At present, a lubricating oil cooling system and a hydraulic system of a conventional gas turbine generator set utilize a motor driving mode, and if the lubricating oil cooling system and the hydraulic system are used for well site operations or other working areas with explosion-proof requirements, an explosion-proof motor needs to be used as a driving motor, thereby increasing the design difficulty. Therefore, how to effectively prevent the overspeed of the gas turbine in the gas turbine generator set and how to drive the lubricating oil cooling system and the hydraulic system of the gas turbine generator set with reduced motors become urgent technical problems to be solved by people.

SUMMARY

The embodiments of the present disclosure aim to provide a gas turbine overspeed protection method and apparatus, an electronic device and a readable storage medium to solve the technical problem of overspeed of a gas turbine in a gas turbine generator set.

In order to achieve the above purpose, a first aspect of the present disclosure provides the following technical solutions.

A gas turbine overspeed protection method is provided. The method includes: acquiring a power utilization load of a generator, which is collected by a sensor, and a rotating speed value of a gas turbine, which is monitored by another sensor; judging whether the power utilization load suddenly decreases or disappears, and when the power utilization load suddenly decreases or disappears, controlling, by a controller, an eddy current retarder to simulate the power utilization load to provide a braking torque for the generator; or judging whether the rotating speed value exceeds a set speed range, and when the rotating speed value exceeds the set speed range, controlling, by a controller, the gas turbine to reduce fuel supply, and opening a discharge valve of a gas compressor to discharge a high-pressure gas to reduce a power output and a rotating speed of the gas turbine.

In some embodiments, wherein after controlling, by the controller, the gas turbine to reduce fuel supply, and opening the discharge valve of the gas compressor to discharge the high-pressure gas to reduce the power output and the rotating speed of the gas turbine, the method includes: when a rotating speed value obtained after reducing the speed of the gas turbine is not reduced to the set speed range, reiterating: controlling, by the controller, the eddy current retarder to simulate the power utilization load to provide the braking torque for the generator; or, controlling, by the controller, the gas turbine to reduce fuel supply, and opening the discharge valve of the gas compressor to discharge the high-pressure gas to reduce the power output and the rotating speed of the gas turbine.

In some embodiments, wherein after controlling, by the controller, the gas turbine to reduce fuel supply, and opening the discharge valve of the gas compressor to discharge the high-pressure gas to reduce the power output and the rotating speed of the gas turbine, the method further includes: when a rotating speed value obtained after reducing the speed of the gas turbine is reduced to the set speed range, sending, by the controller, an instruction to control the eddy current retarder to reduce the braking torque of the generator, and transmitting, by the another sensor, a new rotating speed value to the controller for judging, and when the new rotating speed value is stabilized within the set speed range, releasing the eddy current retarder from working; and when the new rotating speed value of the gas turbine is stabilized within the set speed range, ending the gas turbine overspeed protection method.

In some embodiments, wherein after transmitting, by the sensor, the new rotating speed value to the controller for judging, the method includes: when a rotating speed value obtained after reducing the braking torque of the generator do not exceed the set speed range, reiterating: sending, by the controller, the instruction to control the eddy current retarder to reduce the braking torque of the generator; and when the rotating speed value obtained after reducing the braking torque of the generator exceeds the set speed range, reiterating: controlling, by the controller, the eddy current retarder to simulate the power utilization load to provide the braking torque for the generator; or, controlling, by the controller, the gas turbine to reduce fuel supply, and opening the discharge valve of the gas compressor to discharge the high-pressure gas to reduce the power output and the rotating speed of the gas turbine.

In some embodiments, wherein after the new rotating speed value is stabilized within the set speed range, and the eddy current retarder is released from working, the method includes: when a rotating speed value of the gas turbine after the eddy current retarder stops working is not stabilized within the set speed range, judging whether the rotating speed value of the gas turbine after the eddy current retarder stops working exceeds the set speed range; when the rotating speed value of the gas turbine after the eddy current retarder stops working do not exceed the set speed range, reiterating: sending, by the controller, the instruction to control the eddy current retarder to reduce the braking torque of the generator; and when the rotating speed value of the gas turbine after the eddy current retarder stops working exceeds the set speed range, reiterating: controlling, by the controller, the eddy current retarder to simulate the power utilization load to provide the braking torque for the generator; or, controlling, by the controller, the gas turbine to reduce fuel supply, and opening the discharge valve of the gas compressor to discharge the high-pressure gas to reduce the power output and the rotating speed of the gas turbine.

In some embodiments, wherein after the new rotating speed value is stabilized within the set speed range, and the eddy current retarder is released from working, the method further includes: when a rotating speed value of the gas turbine after the eddy current retarder stops working is not stabilized within the set speed range, reiterating: controlling, by the controller, the eddy current retarder to simulate the power utilization load to provide the braking torque for the generator; or controlling, by the controller, the gas turbine to reduce fuel supply, and opening the discharge valve of the gas compressor to discharge the high-pressure gas to reduce the power output and the rotating speed of the gas turbine.

In some embodiments, wherein the gas turbine overspeed protection method further includes: disposing a multifunctional transmission box between the eddy current retarder and the generator, wherein the multifunctional transmission box is configured for speed change, is capable of reducing a high rotating speed of the gas turbine to a rated low rotating speed of the matched generator, and is capable of providing a plurality of power taking ports for mounting other driving devices, and a hydraulic pump and a hydraulic motor is able to be directly installed on the multifunctional transmission box to drive a lubricating oil cooling system and a hydraulic system.

In order to achieve the above purpose, a second aspect of the present disclosure provides the following technical solutions:

A gas turbine overspeed protection apparatus, including: an acquisition module, configured to acquire a power utilization load of a generator, which is collected by a sensor, and a rotating speed value of a gas turbine and a generator, which is monitored by another sensor; a determination module, configured to judge whether the power utilization load suddenly decreases or disappears, and to judge whether the rotating speed value exceeds a set speed range; and when the power utilization load suddenly decreases or disappears, and when the rotating speed value exceeds the set speed range, a control module, configured to control an eddy current retarder to simulate the power utilization load to provide a braking torque for the generator, and to control the gas turbine to reduce fuel supply, and to open a discharge valve of a gas compressor to discharge a high-pressure gas to reduce a power output and a rotating speed of the gas turbine.

In some embodiments, wherein after the control module controlling, by the controller, the gas turbine to reduce fuel supply, and opening the discharge valve of the gas compressor to discharge the high-pressure gas to reduce the power output and the rotating speed of the gas turbine, the method includes: when a rotating speed value obtained after reducing the speed of the gas turbine is not reduced to the set speed range, reiterating: controlling, by the control module, the eddy current retarder to simulate the power utilization load to provide the braking torque for the generator; or, controlling, by the control module, the gas turbine to reduce fuel supply, and opening the discharge valve of the gas compressor to discharge the high-pressure gas to reduce the power output and the rotating speed of the gas turbine.

In some embodiments, wherein after the control module controlling, by the controller, the gas turbine to reduce fuel supply, and opening the discharge valve of the gas compressor to discharge the high-pressure gas to reduce the power output and the rotating speed of the gas turbine, further includes: when a rotating speed value obtained after reducing the speed of the gas turbine is reduced to the set speed range, sending, by the control module, an instruction to control the eddy current retarder to reduce the braking torque of the generator, and transmitting, by the another sensor, a new rotating speed value to the control module for judging, and when the new rotating speed value is stabilized within the set speed range, releasing the eddy current retarder from working; and when the new rotating speed value of the gas turbine is stabilized within the set speed range, ending the gas turbine overspeed protection method.

In some embodiments, wherein after transmitting, by the sensor, the new rotating speed value to the control module for judging, further includes: when a rotating speed value obtained after reducing the braking torque of the generator do not exceed the set speed range, reiterating: sending, by the control module, the instruction to control the eddy current retarder to reduce the braking torque of the generator; and when the rotating speed value obtained after reducing the braking torque of the generator exceeds the set speed range, reiterating: controlling, by the control module, the eddy current retarder to simulate the power utilization load to provide the braking torque for the generator; or, controlling, by the control module, the gas turbine to reduce fuel supply, and opening the discharge valve of the gas compressor to discharge the high-pressure gas to reduce the power output and the rotating speed of the gas turbine.

In some embodiments, wherein after the new rotating speed value is stabilized within the set speed range, and the eddy current retarder is released from working, the method includes: when a rotating speed value of the gas turbine after the eddy current retarder stops working is not stabilized within the set speed range, judging whether the rotating speed value of the gas turbine after the eddy current retarder stops working exceeds the set speed range; when the rotating speed value of the gas turbine after the eddy current retarder stops working do not exceed the set speed range, reiterating: sending, by the control module, the instruction to control the eddy current retarder to reduce the braking torque of the generator; and when the rotating speed value of the gas turbine after the eddy current retarder stops working exceeds the set speed range, reiterating: controlling, by the control module, the eddy current retarder to simulate the power utilization load to provide the braking torque for the generator; or, controlling, by the control module, the gas turbine to reduce fuel supply, and opening the discharge valve of the gas compressor to discharge the high-pressure gas to reduce the power output and the rotating speed of the gas turbine.

In some embodiments, wherein after the new rotating speed value is stabilized within the set speed range, and the eddy current retarder is released from working, the method further includes: when a rotating speed value of the gas turbine after the eddy current retarder stops working is not stabilized within the set speed range, reiterating: controlling, by the control module, the eddy current retarder to simulate the power utilization load to provide the braking torque for the generator; or controlling, by the control module, the gas turbine to reduce fuel supply, and opening the discharge valve of the gas compressor to discharge the high-pressure gas to reduce the power output and the rotating speed of the gas turbine.

In some embodiments, wherein the gas turbine overspeed protection apparatus further includes: a multifunctional transmission box, which is arranged between the eddy current retarder and the generator, wherein the multifunctional transmission box is configured for speed change, is capable of reducing a high rotating speed of the gas turbine to a rated low rotating speed of the matched generator, and is capable of providing a plurality of power taking ports for mounting other driving devices, and a hydraulic pump and a hydraulic motor is able to be directly installed on the multifunctional transmission box to drive a lubricating oil cooling system and a hydraulic system.

In order to achieve the above purpose, a third aspect of the present disclosure further provides the following technical solutions:

An electronic device, including a processor and a memory, wherein:

the memory is used for storing a computer program; and the processor is used for, when executing the program stored on the memory, implementing the steps of the method in any one of the first aspect or the second aspect.

In order to achieve the above purpose, a fourth aspect of the present disclosure further provides the following technical solutions:

A computer-readable storage medium, wherein a computer program is stored in the computer-readable storage medium, and when executed by a processor, the computer program implements the steps of the method in any one of the first aspect or the second aspect.

Compared with the prior art, the embodiments of the present application have beneficial effects as follows:

The embodiments of the present disclosure provide a gas turbine overspeed protection method and apparatus, an electronic device and a readable storage medium, wherein the gas turbine overspeed protection method includes: acquiring a power utilization load of a generator, which is collected by a sensor, and a rotating speed value of a gas turbine, which is monitored by another sensor; judging whether the power utilization load suddenly decreases or disappears, and when the power utilization load suddenly decreases or disappears, controlling, by a controller, an eddy current retarder to simulate the power utilization load to provide a braking torque for the generator; or, judging whether the rotating speed value exceeds a set speed range, and when the rotating speed value exceeds the set speed range, controlling, by a controller, the gas turbine to reduce fuel supply, and opening a discharge valve of a gas compressor to discharge a high-pressure gas to reduce a power output and a rotating speed of the gas turbine. By means of utilizing the technical solutions in the embodiments of the present disclosure, the technical problem of overspeed of the gas turbine in the gas turbine generator set is effectively solved or improved to a certain extent.

On the other hand, a lubricating oil cooling system and a hydraulic system of a conventional gas turbine generator set utilize a motor driving mode, and when the lubricating oil cooling system and the hydraulic system are used for well site operations or other working areas with explosion-proof requirements, an explosion-proof motor needs to be used as a driving motor, thereby increasing the design difficulty. According to the gas turbine overspeed protection method and apparatus, the electronic device and the readable storage medium provided in the embodiments of the present disclosure, by means of adding the multifunctional transmission box for speed change, a high rotating speed of the gas turbine may be reduced to a rated low rotating speed of the matched generator, and a plurality of power taking ports may be provided for mounting other driving devices. By means of the above solution provided in the present case, the use of the motor is reduced, the hydraulic pump and the hydraulic motor can be directly installed to drive the lubricating oil cooling system and the hydraulic system, and moreover, the heat dissipation power of the lubricating oil cooling system can be changed by flow control, such that the adaptability of the device is better.

In order to more clearly understand the technical means of the present disclosure, implementation may be performed according to the content of the specification, and in order to make the above and other purposes, features and advantages of the present disclosure more obvious and comprehensible, preferred embodiments are listed below, and a detailed description will be given below in detail with reference to the drawings. Other features and advantages of the present disclosure will be set forth in the following specification, and in part become apparent from the specification, or may be embodied by practicing the present disclosure. The purposes and other advantages of the present disclosure may be implemented and obtained by structures that are particularly pointed out in the specification, claims and drawings.

BRIEF DESCRIPTION OF THE DRAWINGS

To illustrate technical solutions in the embodiments of the present disclosure or in the prior art more clearly, a brief introduction on the drawings which are needed in the description of the embodiments, or the prior art is given below. Apparently, the drawings in the description below are merely some of the embodiments of the present disclosure, based on which other drawings may be obtained by those ordinary skilled in the art without any creative effort.

DETAILED DESCRIPTION OF THE EMBODIMENTS

Figure 1:
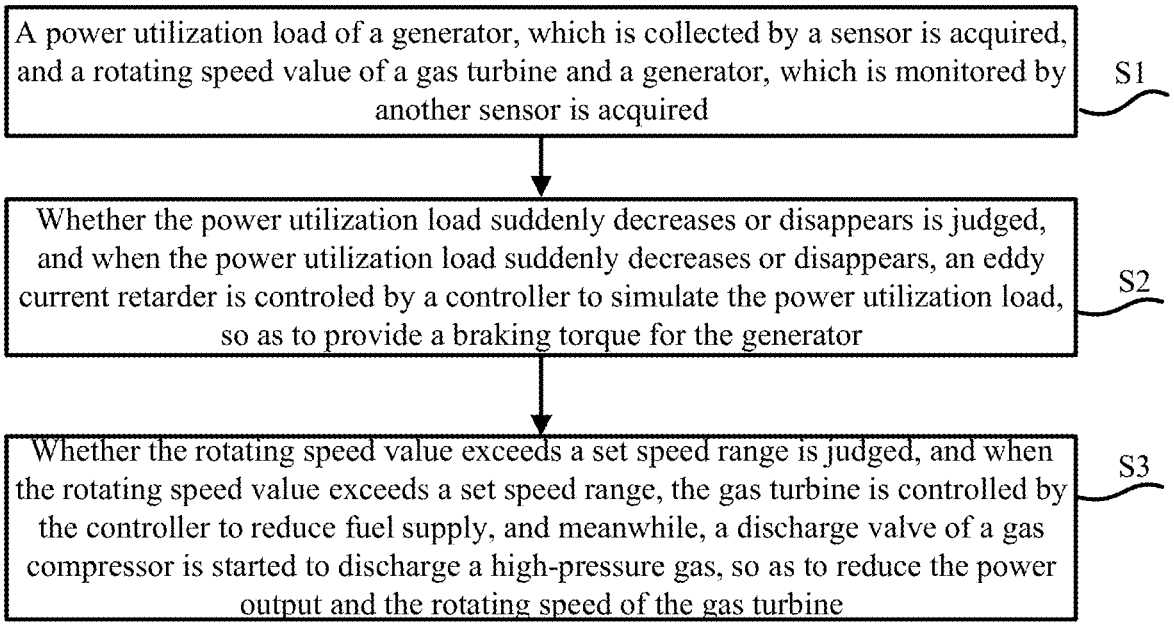
FIG. 1 is a schematic flow diagram of a gas turbine overspeed protection method in an embodiment of the present disclosure.

The embodiments of the present disclosure will be described below by specific examples, and those skilled in the art may easily understand other advantages and effects of the present disclosure from the disclosure of the present specification. Obviously, the described embodiments are only a part of the embodiments of the present disclosure but are not all embodiments. The present disclosure may also be implemented or applied in other different specific embodiments, and various modifications or changes may also be made to various details in the present specification on the basis of different viewpoints and applications, without departing from the spirit of the present disclosure. It should be noted that, in the case of no conflict, the following embodiments and features in the embodiments may be combined with each other. All of other embodiments, obtained by those ordinary skilled in the art based on the embodiments of the present disclosure without any creative effort, fall into the protection scope of the present disclosure.

It should be noted that, various aspects of embodiments within the scope of the appended claims are described below. It should be apparent that, the aspects described herein may be embodied in a wide variety of forms, and any particular structures and/or functions described herein are illustrative only. Based on the present disclosure, those skilled in the art to which the present disclosure belongs should understand that one aspect described herein may be implemented independently of any other aspect, and two or more of these aspects may be combined in various ways. For example, a device may be implemented and/or a method may be practiced by using any number of aspects set forth herein. In addition, the device may be implemented and/or the method may be practiced by using other structures and/or functions other than one or more of the aspects set forth herein.

It should also be noted that, the drawings provided in the following embodiments merely illustrate the basic concepts of the present disclosure in a schematic manner, and only components related to the present disclosure are shown in the drawings rather than drawn according to the numbers, shapes and sizes of the components in actual implementation, and the types, numbers and proportions of the components in actual implementation may be a random change, and the layout types of the components may also be more complex.

In addition, in the following description, specific details are provided in order to facilitate a thorough understanding of examples. However, those skilled in the art to which the present disclosure belongs will appreciate that the aspects may be practiced without these specific details.

At present, a gas turbine generator set is widely applied due to the advantages of large output power, high energy density, low noise, low emission and the like, but the gas turbine generator set faces a difficult problem of overspeed of a gas turbine. The current solution is to prevent the overspeed of the gas turbine by means of reducing the fuel supply of the gas turbine, controlling the opening and closing of a discharge valve on the gas turbine, discharging a high-pressure gas from a gas compressor to reduce air supply, or discharging a high-pressure and high-temperature gas from the inlet of a power turbine to reduce the power input. However, the above manner has many disadvantages, for example, the discharge of the high-pressure and high-temperature gas is difficult, the reduction of the fuel and the discharge of the high-pressure gas have hysteresis, and the overspeed of the gas turbine cannot be well prevented after the generator set is subjected to load shedding. Moreover, the whole shafting of the generator set has very large inertia, especially when the load of a heavy generator set suddenly decreases or disappears, the rotating speed suddenly rises under the action of an inertia force, and the rotating speed cannot be effectively stabilized in time just by reducing the rotating speed and the power of the gas turbine; and a lubricating oil cooling system and a hydraulic system of a conventional gas turbine generator set utilize a motor driving mode, and if the lubricating oil cooling system and the hydraulic system are used for well site operations or other working areas with explosion-proof requirements, an explosion-proof motor needs to be used as a driving motor, thereby increasing the design difficulty. Therefore, how to effectively solve or improve, to a certain extent, the overspeed of the gas turbine in the gas turbine generator set and how to drive the lubricating oil cooling system and the hydraulic system of the gas turbine generator set with reduced motors become urgent technical problems to be solved by people.

Therefore, in order to solve or effectively improve the above-mentioned problems, FIG. 1 shows a schematic flow diagram of a gas turbine overspeed protection method in the present embodiment. As shown in FIG. 1, the present embodiment provides a gas turbine overspeed protection method. The gas turbine overspeed protection method includes:

S1, a power utilization load of a generator, which is collected by a sensor B is acquired, and a rotating speed value of a gas turbine and a generator, which is monitored by a sensor A is acquired;

S2, whether the power utilization load suddenly decreases or disappears is judged, when the power utilization load suddenly decreases or disappears, the rotating speeds of the gas turbine, the generator and the whole shafting will rise suddenly, then, an eddy current retarder is controlled by a controller to simulate the power utilization load to provide a braking torque for the generator. Therefore, the rotating speed of the gas turbine is reduced, the rise in the rotating speeds of the gas turbine, the generator and the whole shafting is suppressed, the electric energy required by the eddy current retarder is from the generator, at this time, the eddy current retarder not only provides the braking torque for the system, but can also be used as a load of the generator, so that overspeed caused by the sudden decrease or disappearance of the load of the generator is slowed down; or S3, whether the rotating speed value exceeds a set speed range is judged, when the rotating speed value exceeds the set speed range, the gas turbine is controlled by the controller to reduce fuel supply, and a discharge valve of a gas compressor is opened to discharge a high-pressure gas to reduce the power output and the rotating speed of the gas turbine. By means of the technical solutions in the embodiment of the present disclosure, the technical problem of overspeed of the gas turbine in the gas turbine generator set is effectively solved or improved to a certain extent. It should be noted that, the rotating speed range of the gas turbine may be acquired from a use manual given by a manufacturer during production and may also be acquired from a highest limit value and a rotating speed range, which are given by the manufacturer during production according to gas turbines of different model numbers. For example, the manufacturer distinguishes the model numbers during production, and the rotating speed ranges, which may be borne by the gas turbines of different model numbers, are also different. The rotating speed range of a conventional gas turbine is controlled to be about 3000 r/min, which will not be described in detail herein. As an extension, the eddy current retarder is an apparatus for implementing retardance by using eddy current that is generated by a rotating metal disk under the action of a magnetic field, a front rotor and a rear rotor of the eddy current retarder are connected to an input flange of a main speed reducer via a transition disk, a stator housing is fixed on a main speed reducer housing by a bracket, and an excitation coil is installed on a stator. During work, current is injected into an automobile storage battery to generate a magnetic field, an eddy current is induced in the rotor, an eddy current magnetic field generates a braking torque for the rotor, and the value of the braking torque is related to the magnitude of the excitation current (controlled by a selector) and the rotating speed of the rotor. A cooling air duct is cast in a rotor interlayer, so that heat generated by the eddy current is dissipated by forced convection.

In order to further determine whether the rotating speed values are reduced to a set speed range, after S3, the method includes: S3*a*, if a rotating speed value obtained after reducing the speed of the gas turbine is not reduced to the set speed range, the method includes reiterating: controlling, by the controller, the eddy current retarder to simulate the power utilization load to provide the braking torque for the generator; or, controlling, by the controller, the gas turbine to reduce fuel supply, and opening the discharge valve of the gas compressor to discharge the high-pressure gas to reduce the power output and the rotating speed of the gas turbine. After S3, the method further includes: S3*b*, when a rotating speed value obtained after reducing the speed of the gas turbine is reduced to the set speed range, an instruction is sent by the controller to control the eddy current retarder to reduce the braking torque of the generator, and a new rotating speed value is transmitted by the another sensor to the controller for judging, and when the new rotating speed value is stabilized within the set speed range, the eddy current retarder is released from working; and when the new rotating speed value of the gas turbine is stabilized within the set speed range, the gas turbine overspeed protection method is ended.

In some embodiments, in S3*b*, after the step: transmitting, by the sensor, the new rotating speed value to the controller for judging, the method includes: when a rotating speed value obtained after reducing the braking torque of the generator do not exceed the set speed range, the method includes reiterating: the instruction is sent by the controller to control the eddy current retarder to reduce the braking torque of the generator; and when the rotating speed value obtained after reducing the braking torque of the generator exceeds the set speed range, the method includes reiterating: the eddy current retarder is controlled by the controller to simulate the power utilization load to provide the braking torque for the generator; or, the gas turbine is controlled by the controller to reduce fuel supply, and the discharge valve of the gas compressor is opened to discharge the high-pressure gas to reduce the power output and the rotating speed of the gas turbine.

In some embodiments, in S3*b*, after the step: when the new rotating speed value is stabilized within the set speed range, and the eddy current retarder is released from working, the method includes: when a the rotating speed value of the gas turbine after the eddy current retarder stops working is not stabilized within the set speed range, whether the rotating speed value of the gas turbine after the eddy current retarder stops working exceeds the set speed range is judged;

when the rotating speed value of the gas turbine after the eddy current retarder stops working do not exceed the set speed range, the method includes reiterating: the instruction is sent by the controller to control the eddy current retarder to reduce the braking torque of the generator; and when the rotating speed value of the gas turbine after the eddy current retarder stops working exceeds the set speed range, the method includes reiterating: the eddy current retarder is controlled by the controller to simulate the power utilization load to provide the braking torque for the generator; or, the gas turbine is controlled by the controller to reduce fuel supply, and opening the discharge valve of the gas compressor to discharge the high-pressure gas to reduce the power output and the rotating speed of the gas turbine.

In some embodiments, in S3*b*, after the step: when the new rotating speed value is stabilized within the set speed range, and the eddy current retarder is released from working, the method further includes: when a rotating speed value of the gas turbine after the eddy current retarder stops working is not stabilized within the set speed range, the method includes reiterating: the eddy current retarder is controlled by the controller to simulate the power utilization load to provide the braking torque for the generator; or the gas turbine is controlled by the controller to reduce fuel supply, and the discharge valve of the gas compressor is opened to discharge the high-pressure gas to reduce the power output and the rotating speed of the gas turbine. In the present case, the eddy current retarder is additionally arranged between the gas turbine, such that the overspeed of the gas turbine can be effectively prevented. The eddy current retarder can make a quick response, and thus can quickly reflect and simulate the torque generated by the load to provide the braking torque for the generator set in time. The rotating speed of the gas turbine is effectively stabilized, the overspeed of the gas turbine is prevented, and the hysteresis of a gas turbine fuel system and a gas compressor exhaust system in controlling the rotating speed of the gas turbine is compensated. Moreover, a large amount of electric energy required by the eddy current retarder is provided by the generator, such that the load of the generator is increased, and an effect of consuming the power of the gas turbine to stabilize the rotating speed of the gas turbine can also be realized. In addition, the lubricating oil cooling system and the hydraulic system of the conventional gas turbine generator set utilize the motor driving mode, and when the lubricating oil cooling system and the hydraulic system are used for well site operations or other working areas with explosion-proof requirements, the explosion-proof motor needs to be used as the driving motor, thereby increasing the design difficulty. A multifunctional transmission box is additionally arranged in the present case, the multifunctional transmission box is used for speed change, is capable of reducing a high rotating speed of the gas turbine to a rated low rotating speed of the matched generator, and is capable of providing a plurality of power taking ports for mounting other driving devices. In addition, a hydraulic pump and a hydraulic motor may also be directly installed on the multifunctional transmission box to drive the lubricating oil cooling system and the hydraulic system. Therefore, the use of the explosion-proof motor can be avoided, the heat dissipation power of the lubricating oil cooling system can be changed by flow control, such that the adaptability of the device is better, and the hydraulic pump and the hydraulic motor may be directly installed on the multifunctional transmission box to drive the lubricating oil cooling system and the hydraulic system.

Figure 2:
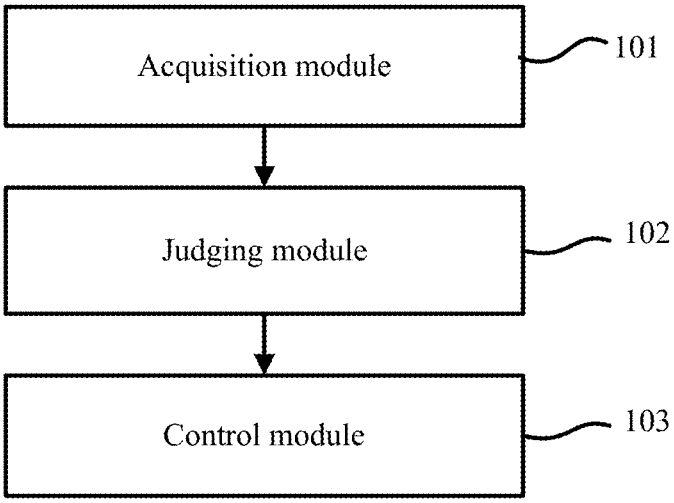
FIG. 2 is a schematic structural diagram of a gas turbine overspeed protection apparatus in an embodiment of the present disclosure.
Figure 3:
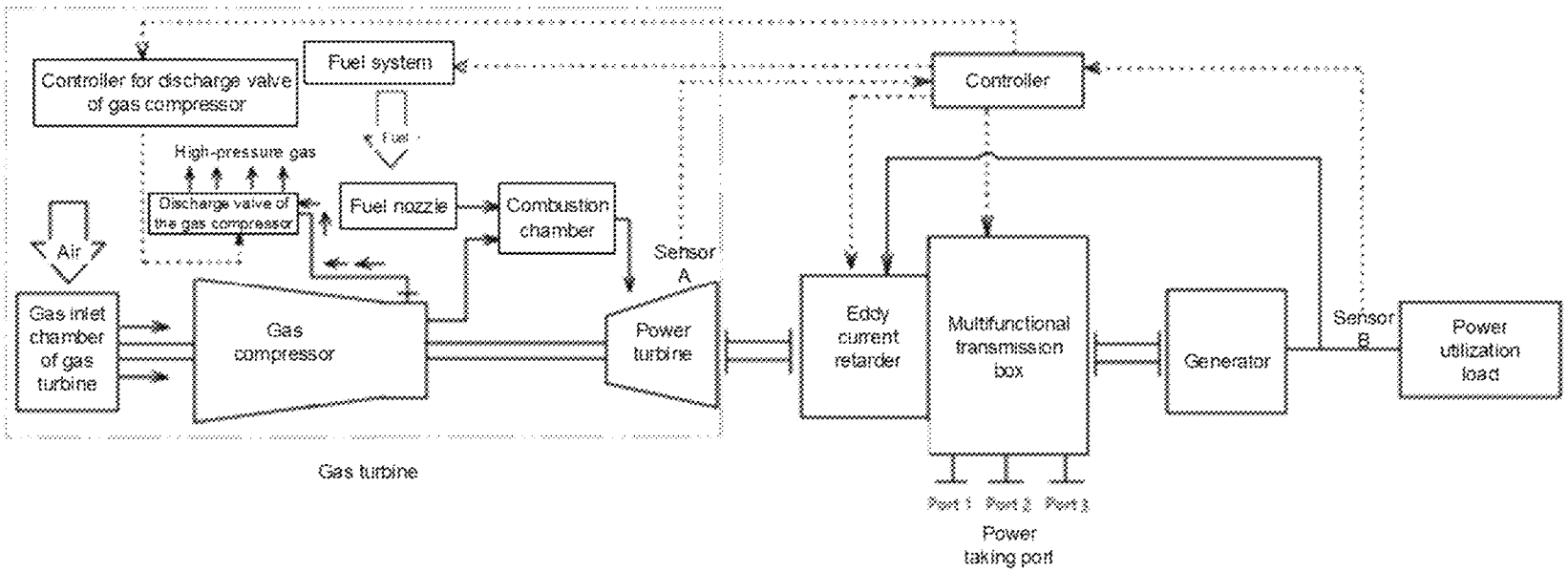
FIG. 3 is a schematic layout diagram of a gas turbine overspeed protection apparatus in an embodiment of the present disclosure.
Figure 4:
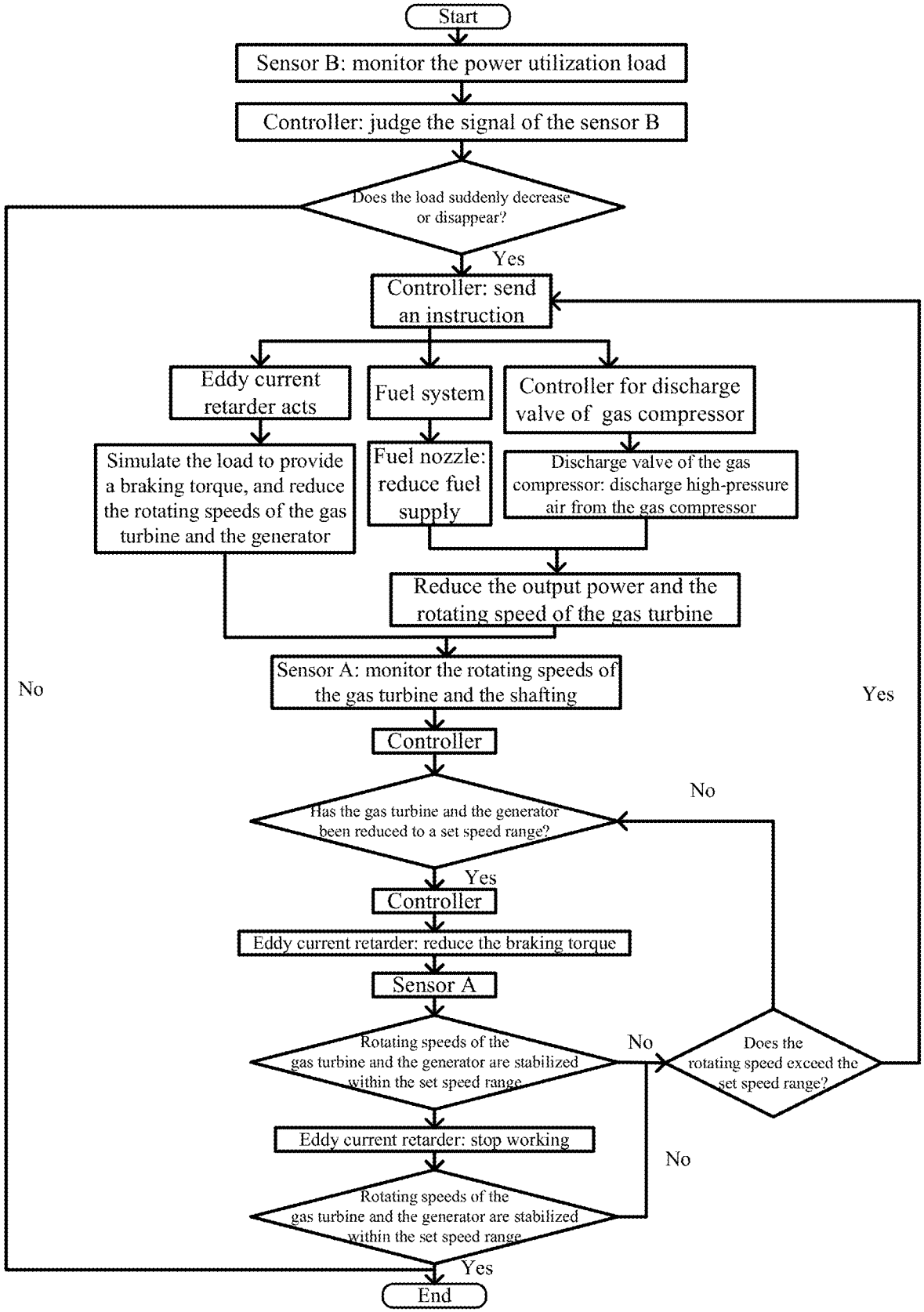
FIG. 4 is a schematic diagram of a control logic of a gas turbine overspeed protection apparatus in an embodiment of the present disclosure.

Correspondingly, FIG. 2 shows a schematic structural diagram of a gas turbine overspeed protection apparatus in the present embodiment, FIG. 3 shows a schematic layout diagram of the gas turbine overspeed protection apparatus in the present embodiment, and FIG. 4 shows a schematic diagram of a control logic of the gas turbine overspeed protection apparatus in the present embodiment. As shown in FIG. 2 to FIG. 4, gas turbines used at the present stage are divided into multi-shaft gas turbines and single-shaft gas turbines, a multi-shaft gas turbine generator set requires no speed change, when the solution shown in FIG. 3 is utilized for arrangement, the multifunctional transmission box is merely used for transmitting power and providing a power taking port, if the multifunctional transmission box is removed for arrangement, the power taking port cannot be provided to drive other devices. For a single-shaft gas turbine, merely the solution shown in FIG. 3 can be utilized for arrangement, at this time, the multi-functional transmission box is used for speed change, is capable of converting a high rotating speed of the gas turbine into a rated low rotating speed of the matched generator, and is capable of providing a plurality of power taking ports for mounting other driving devices. By means of the above solution provided in the present case, the use of motor can be reduced, and a hydraulic pump and a hydraulic motor can be directly installed on the multifunctional transmission box to drive a lubricating oil cooling system and a hydraulic system. In one embodiment, the gas turbine overspeed protection apparatus includes a gas turbine, an eddy current retarder, a multifunctional transmission box and a generator, wherein the eddy current retarder and the multifunctional transmission box are integrated together and may also be separately arranged, the gas turbine, the eddy current retarder, the multifunctional transmission box and the generator are connected by using a coupler, and when the device operates normally, the gas turbine overspeed protection apparatus further includes:

an acquisition module 101, configured to acquire a power utilization load of the generator, which is collected by a sensor B, and a rotating speed value of the gas turbine, which is monitored by a sensor B;

a judging module 102, configured to judge whether the power utilization load suddenly decreases or disappears, and to judge whether the rotating speed values exceed a set speed range; and if the power utilization load suddenly decreases or disappears, the rotating speeds of the gas turbine, the generator and the whole shafting will rise suddenly, and if the rotating speed value exceeds the set speed range, a control module 103, configured to control the eddy current retarder to simulate the power utilization load to provide a braking torque for the generator. Therefore, the rotating speed of the gas turbine is reduced, the rise in the rotating speeds of the gas turbine, the generator and the whole shafting is suppressed. The electric energy required by the eddy current retarder is from the generator, at this time, the eddy current retarder not only provides the braking torque for the system but can also be used as a load of the generator, so that overspeed caused by the sudden decrease or disappearance of the load of the generator is slowed down. The control module 103 is further configured to control the gas turbine to reduce fuel supply, and to open a discharge valve of a gas compressor to discharge a high-pressure gas to reduce the power output and the rotating speed of the gas turbine.

In some embodiments, after the step: the control module 103 controlling, by the controller, the gas turbine to reduce fuel supply, and opening the discharge valve of the gas compressor to discharge the high-pressure gas to reduce the power output and the rotating speed of the gas turbine, the method includes:

if the rotating speed value is not reduced to a set speed range, the method includes reiterating: the eddy current retarder is controlled by the control module 103 to simulate the power utilization load to provide the braking torque for the generator; or, the gas turbine is controlled by the control module 103 to reduce fuel supply, and the discharge valve of the gas compressor is controlled to discharge the high-pressure gas to reduce the power output and the rotating speed of the gas turbine.

Further, after the step: the control module 103 controlling, by the controller, the gas turbine to reduce fuel supply, and opening the discharge valve of the gas compressor to discharge the high-pressure gas to reduce the power output and the rotating speed of the gas turbine, the method further includes:

if the rotating speed values are reduced to the set speed range, an instruction is sent by the control module 103 to control the eddy current retarder to reduce the braking torque of the generator, and the new rotating speed value is transmitted by the sensor to the control module 103 for determination, and if the rotating speed values are stabilized within the set speed range, the eddy current retarder stops working; and if the rotating speeds of the gas turbine are stabilized within the set speed range, the method ends.

Further, after the step of transmitting, by the sensor, the new rotating speed values to the control module 103 for determination, the method includes:

if the rotating speed values do not exceed the set speed range, the method includes reiterating: the instruction is sent by the control module 103 to control the eddy current retarder to reduce the braking torque of the generator; and if the rotating speed values exceed the set speed range, the method includes reiterating: the eddy current retarder is controlled by the control module 103 to simulate the power utilization load to provide the braking torque for the generator; or, the gas turbine is controlled by the control module 103 to reduce fuel supply, and the discharge valve of the gas compressor is opened to discharge the high-pressure gas to reduce the power output and the rotating speed of the gas turbine.

In some embodiments, after the rotating speed values are stabilized within the set speed range, and the eddy current retarder is released from working, the method includes:

if the rotating speed of the gas turbine is not stabilized within the set speed range, whether the rotating speed value exceeds the set speed range is judged;

if the rotating speed value do not exceed the set speed range, the method includes reiterating: the instruction is sent by the control module 103 to control the eddy current retarder to reduce the braking torque of the generator; and if the rotating speed value exceeds the set speed range, the method includes reiterating: the eddy current retarder is controlled by the control module 103 to simulate the power utilization load to provide the braking torque for the generator; or, the gas turbine is controlled by the control module 103 to reduce fuel supply, and the discharge valve of the gas compressor is opened to discharge the high-pressure gas to reduce the power output and the rotating speed of the gas turbine.

Further, after the step: if the rotating speed value is stabilized within the set speed range, the eddy current retarder stops working, the method further includes:

if the rotating speed of the gas turbine is not stabilized within the set speed range, reiterating: the eddy current retarder is controlled by the control module 103 to simulate the power utilization load to provide the braking torque for the generator; or the gas turbine is controlled by the control module 103 to reduce fuel supply, and the discharge valve of the gas compressor is opened to discharge the high-pressure gas to reduce the power output and the rotating speed of the gas turbine.

Based on the same technical concept as that in the foregoing embodiment of the gas turbine overdue protection method, an embodiment of the present disclosure further provides an electronic device, including a processor and a memory. The memory is used for storing a computer program. The processor is used for, when executing the program stored on the memory, implementing the method steps in the embodiment of the gas turbine overdue protection method.

Of course, those skilled in the art should understand that the above-mentioned server may further include well-known structural components such as a communication interface and a communication bus. The processor, the communication interface and the memory communicate with each other through the communication bus. The above-mentioned processor may be a central processing unit (Central Processing Unit, CPU), a network processor (Network Processor, NP), and the like, and may also be a digital signal processor (Digital Signal Processing, DSP), an application specific integrated circuit (Application Specific Integrated Circuit, ASIC), a field programmable gate array (Field Programmable Gate Array, FPGA), or other programmable logic devices, a discrete gate or a transistor logic device, or a discrete hardware component.

The above-mentioned memory may include a random access memory (Random Access Memory, RAM), and may also include a non-volatile memory (non-volatile memory, NVM) or at least one disk memory. In some embodiments, the memory may also be at least one storage apparatus, which is located away from the processor.

With regard to the working principles of the present embodiment, the technical problems to be solved and the implemented technical effects, reference may be made to related description in the foregoing method embodiment, and details are not described herein again.

Based on the same technical concept as that in the foregoing embodiment of the gas turbine overdue protection method, an embodiment of the present disclosure further provides a computer-readable storage medium. A computer program is stored in the computer-readable storage medium, and when executed by a processor, the computer program implements the method steps in the embodiment of the gas turbine overdue protection method.

The above-mentioned computer-readable storage medium may include, but is not limited to, a random access memory (RAM), a dynamic random access memory (DRAM), a static random access memory (SRAM), a read-only memory (ROM), a programmable read-only memory (PROM), an erasable programmable read-only memory (EPROM), an electrically erasable programmable read-only memory (EEPROM), a flash memory (e.g., an NOR-type flash memory or an NAND type flash memory), a content addressable memory (CAM), a polymer memory (e.g., a ferroelectric polymer memory), a phase change memory, a bidirectional switch semiconductor memory, a silicon-oxide-silicon nitride-silicon oxide-silicon (Silicon-Oxide-Nitride-Oxide-Silicon, SONOS) memory, a magnetic card or an optical card, or any other suitable type of computer-readable storage medium.

A fracturing operation has two basic requirements on fracturing equipment. Firstly, there can be no displacement output at an engine warm-up stage, and a fracturing pump can be started to provide displacement only when necessary. Secondly, in case of an emergency situation that includes an overpressure situation, the output needs to be cut off urgently, that is, the fracturing pump needs to be separated from a front end to avoid accidents.

Some existing fracturing equipment is provided with a clutch. However, because the clutch cannot be engaged at a high speed, the clutch can be engaged only before starting, and otherwise, the clutch may be damaged. Therefore, the clutch is engaged before starting, and a turbine engine is started when the displacement is needed; and in case of emergency, the clutch is separated, and the fracturing pump is stopped under an inertia effect or a load of a wellhead.

However, some problems occur in the case where a turbine fracturing device adopts the clutch to implement the quick separation. Firstly, the clutch must be engaged before the starting of the equipment, which restricts an application range of the clutch. The clutch can be engaged only before the starting. If the clutch is engaged again after the overpressure, it is necessary to stop the equipment, thus the quick starting of the equipment cannot be realized. Secondly, after the overpressure protection, the clutch separates the fracturing pump quickly from a speed reducer, and the instantaneous loss of load leads to possible runaway of the turbine engine, which brings risks to the turbine engine. Of course, in the case where the fracturing pump is stopped under the inertia effect or the load of the wellhead, which still has certain impact on the rear end. Moreover, the clutch is not suitable for being started and stopped frequently, which easily causes the damage to seals, shortens the service life, and increases the maintenance cost.

Figure 5:
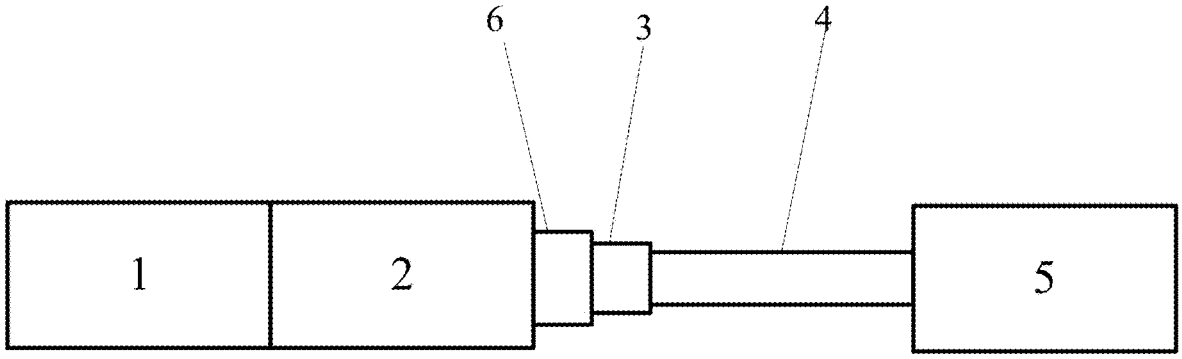
FIG. 5 is a schematic diagram of a turbine fracturing device provided by an embodiment of the present disclosure.

FIG. 5 is a schematic diagram of a turbine fracturing device provided by an embodiment of the present disclosure. As illustrated in FIG. 5, the turbine fracturing device includes a turbine engine 1, a speed reducer 2, a torque limiter 3, a transmission mechanism 4, and a fracturing pump 5. As illustrated in FIG. 5, the turbine engine 1, the speed reducer 2, the torque limiter 3, the transmission mechanism 4, and the fracturing pump 5 are connected in sequence to form a transmission system of the turbine fracturing device. In some embodiments, the transmission mechanism 4 includes a coupling. In some embodiments, the fracturing pump 5 includes a piston pump. In some embodiments, the fracturing pump 5 is configured to suck low-pressure fracturing fluid and pressurize the low-pressure fracturing fluid to form high-pressure fracturing fluid. The pressure of the high-pressure fracturing fluid is greater than the pressure of the low-pressure fracturing fluid. The low-pressure fracturing fluid may also be referred to as suction fluid. The high-pressure fracturing fluid may also be referred to as discharge fluid. The low-pressure fracturing fluid may also be referred to as fluid of first pressure. The high-pressure fracturing fluid may also be referred to as fluid of second pressure. In some embodiments, the fracturing pump 5 is configured to suck the fluid of the first pressure and discharge the fluid of the second pressure. The second pressure is greater than the first pressure. In some embodiments, the turbine fracturing device provided by some embodiments of the present disclosure may also not be provided with the torque limiter 3. In this case, the speed reducer 2 is connected with the fracturing pump 5 through the transmission mechanism 4.

As illustrated in FIG. 5, a brake mechanism 6 may be arranged between the speed reducer 2 and the fracturing pump 5 to keep the speed reducer 2 and the fracturing pump 5 in a disconnected state. According to the turbine fracturing device provided by the embodiments of the present disclosure, the brake mechanism 6 is provided to make the speed reducer 2 disconnected from the fracturing pump 5. The speed reducer 2 and the fracturing pump 5 may be in a disconnected or a connected state. In the embodiments of the present disclosure, when the speed reducer 2 and the fracturing pump 5 are in the disconnected state, the fracturing pump 5 is in a non-operating state, when the speed reducer 2 and the fracturing pump 5 are in the connected state, the fracturing pump 5 is in an operating state.

Figure 6:
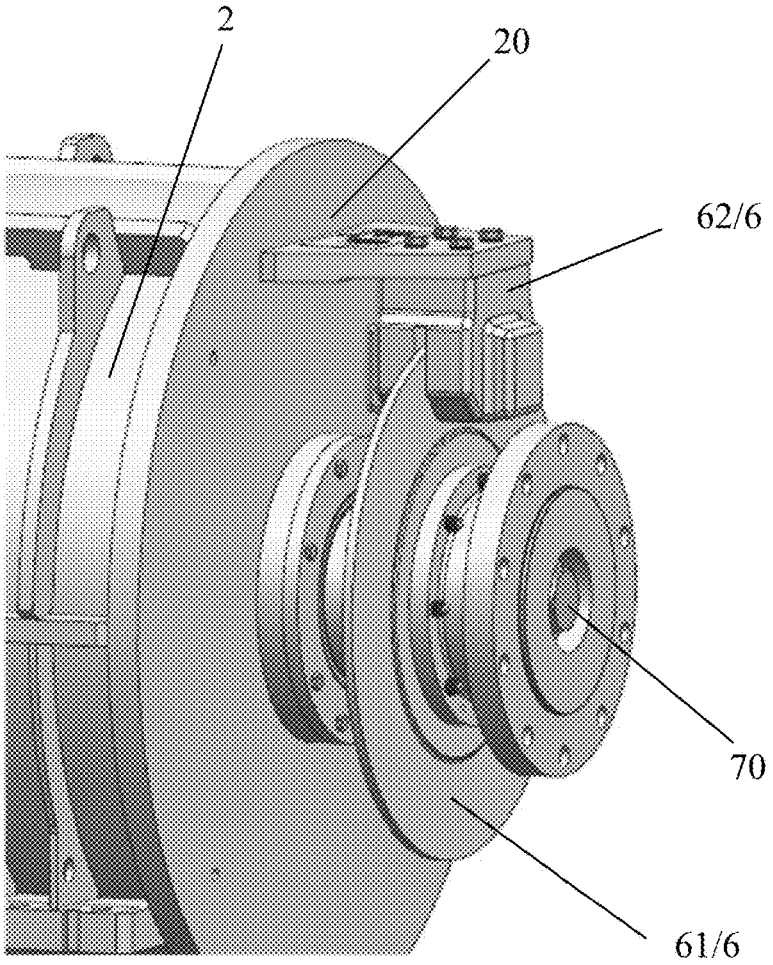
FIG. 6 is a perspective schematic view of a brake mechanism of a turbine fracturing device provided by an embodiment of the present disclosure.
Figure 7:
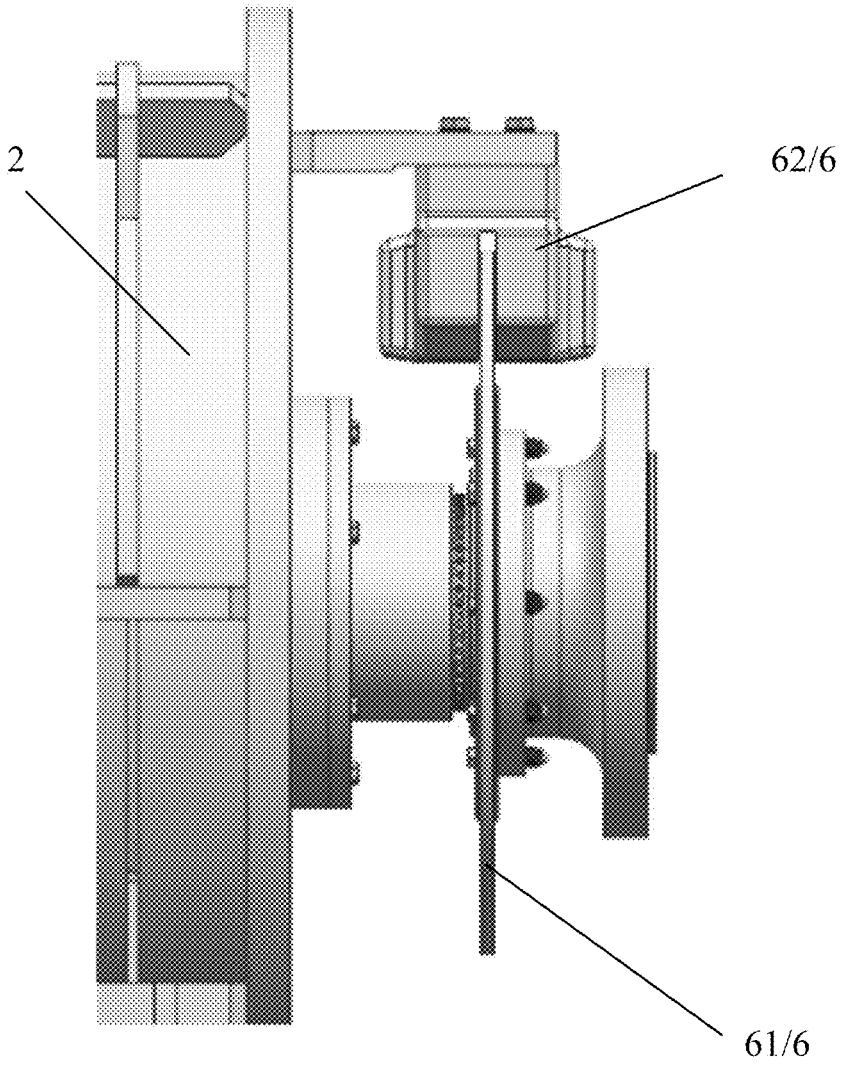
FIG. 7 is a side view of a brake mechanism of a turbine fracturing device provided by an embodiment of the present disclosure.

FIG. 6 is a perspective schematic view of a brake mechanism of a turbine fracturing device provided by an embodiment of the present disclosure. FIG. 7 is a side view of a brake mechanism of a turbine fracturing device provided by an embodiment of the present disclosure. As illustrated in FIG. 6 and FIG. 7, the brake mechanism 6 includes a brake plate 61 and a brake block 62. In some embodiments, the friction between the brake plate 61 and the brake block 62 plays a brake role. The brake block 62 may also be referred to as a friction block. In a brake state, the brake mechanism 6 is used as a load of an output shaft of the turbine engine to bear the power output of the output shaft of the turbine engine, so that the fracturing pump 5 is in the non-operating state. FIG. 5 to FIG. 7 are illustrated with reference to the case where the brake mechanism 6 is located at a side of speed reducer 2 opposite to a side of the speed reducer 2 that is connected with the turbine engine 1, by way of example, but the embodiments of the present disclosure are not limited thereto. In other embodiments, the brake mechanism 6 may also be arranged at other suitable positions. In some embodiments, the brake mechanism 6 may be arranged between the transmission mechanism 4 and the fracturing pump 5, i.e., arranged on an input shaft of the fracturing pump 5.

The embodiments of the present disclosure take the turbine fracturing device illustrated in FIG. 5 to FIG. 7 as an example for description, but are not limited thereto. The structure of the turbine fracturing device may be determined according to the requirements.

Figure 8:
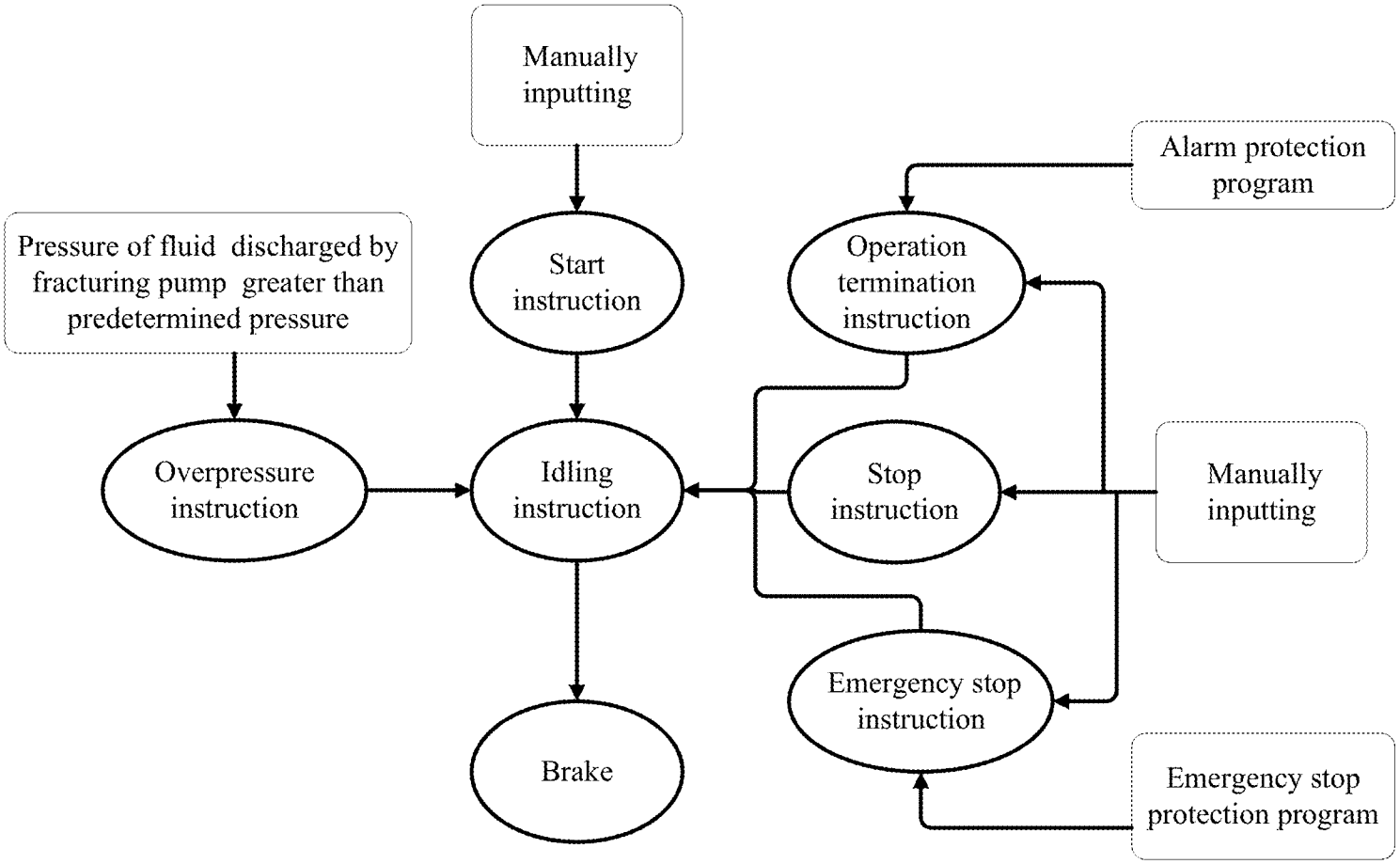
FIG. 8 is a schematic diagram of an operation method of a turbine fracturing device provided by an embodiment of the present disclosure.

FIG. 8 is a schematic diagram of an operation method of the turbine fracturing device provided by an embodiment of the present disclosure. As illustrated in FIG. 8, the entire operation of the turbine fracturing device is carried out according to an idling instruction. The idling instruction controls the brake operation directly.

At least one embodiment of the present disclosure provides an operation method of a turbine fracturing device. Referring to FIG. 5 to FIG. 8, the turbine fracturing device includes a turbine engine 1, a speed reducer 2, a brake mechanism 6, and a fracturing pump 5. The operation method of the turbine fracturing device includes: driving, by the turbine engine 1, the fracturing pump 5 to perform a fracturing operation through the speed reducer 2 so as to keep the fracturing pump 5 in an operating state; and in response to an idling instruction, the turbine engine 1 entering an idling state, and triggering a brake operation to keep the fracturing pump 5 in a non-operating state. When the turbine engine 1 is in the idling state, the output power of the turbine engine 1 is very small.

In some embodiments, the operation method of the turbine fracturing device includes: in response to the idling instruction, the turbine engine 1 entering the idling state; and the idling instruction triggering a brake instruction, and in response to the brake instruction, triggering the brake operation to keep the fracturing pump 5 in the non-operating state. Responding to the brake instruction or performing the brake operation, the turbine fracturing device enters a brake state. In some embodiments, the brake operation is to control a rotation speed of an output shaft of a reduction gearbox. In some embodiments, the brake instruction is triggered at the same time when the turbine engine 1 is in the idling state. In some embodiments, the brake instruction is triggered at the same time when the idling instruction is issued.

The fracturing pump 5 is in the operating state, which refers to that the fracturing pump 5 sucks low-pressure fluid and discharges high-pressure fluid. The fracturing pump 5 is in the non-operating state, which refers to that the fracturing pump 5 does not suck the low-pressure fluid and does not discharge the high-pressure fluid. In some embodiments, the fracturing pump 5 is in the operating state, which may refer to that the fracturing pump 5 has displacement output. The fracturing pump 5 is in the non-operating state, which refers to that the fracturing pump 5 has no displacement output.

Referring to FIG. 5, an output shaft of the turbine engine 1 is connected with an input shaft of the speed reducer 2. An output shaft of the speed reducer 2 is connected with the input shaft of the fracturing pump 5.

The idling state refers to the state of the turbine engine 1. In response to the idling instruction, the turbine fracturing device adjusts the rotation speed of the output shaft of the turbine engine 1. In the case where the turbine engine 1 is driven by fuel oil, the rotation speed of the output shaft of the turbine engine 1 may be adjusted by adjusting an oil intake quantity. The rotation speed of the output shaft of the turbine engine 1 may be reduced by reducing the oil intake quantity. When the turbine engine 1 is driven by gas, the rotation speed of the output shaft of the turbine engine 1 may be adjusted by adjusting the gas intake quantity. In some embodiments, the rotation speed of the output shaft of the turbine engine 1 may be reduced by reducing the gas intake quantity.

In the idling state, the rotation speed of the output shaft of the turbine engine 1 is less than the rotation speed of the turbine engine 1 when driving the fracturing pump 5 to perform the fracturing operation. In the idling state, the rotation speed of the output shaft of the turbine engine 1 is stable and greater than a set value, where the set value is 0. That is, in the idling state, the rotation speed of the output shaft of the turbine engine 1 is greater than 0. In the idling state, the rotation speed of the output shaft of the turbine engine 1 is relatively small. In some embodiments, in a brake state, the rotation speed of the output shaft of the turbine engine 1 is 0. When the turbine fracturing device is in the operating state, the rotation speed of the output shaft of the turbine engine 1 is greater than the rotation speed of the input shaft of the fracturing pump 5.

As illustrated in FIG. 8, the operation method of the turbine fracturing device further includes: triggering an overpressure instruction in the case where the pressure of the fluid of the second pressure discharged by the fracturing pump 5 is greater than an overpressure protection value, and the overpressure instruction triggering the idling instruction. In response to the overpressure instruction, the turbine fracturing device enters an overpressure protection state.

The overpressure instruction is sourced from a pressure sensor of the fracturing pump. The pressure sensor is configured to detect a pressure of the high-pressure fracturing fluid of the fracturing pump. When the pressure sensor detects that the pressure of the high-pressure fracturing fluid is greater than the predetermined overpressure protection value, the overpressure instruction is triggered directly, and the idling state is further triggered.

In some embodiments, as illustrated in FIG. 8, the operation method of the turbine fracturing device further includes: starting the turbine engine 1 in response to a start instruction before the fracturing pump 5 is in the operating state; and the start instruction triggering the idling instruction, so that the turbine engine 1 is in the idling state during a start process of the turbine engine 1.

In some embodiments, during the start process of the turbine engine 1, the start instruction is controlled manually; in response to the start instruction, the turbine fracturing device executes a start process; and during the entire start process, the turbine fracturing device is always in the idling state.

In some embodiments, as illustrated in FIG. 8, the operation method of the turbine fracturing device further includes: terminating the operating state of the fracturing pump 5 in response to an operation termination instruction when the fracturing pump 5 is in the operating state, and the operation termination instruction triggering the idling instruction.

In some embodiments, as illustrated in FIG. 8, the operation termination instruction is inputted manually to terminate the operating state of the fracturing pump 5.

In some embodiments, as illustrated in FIG. 8, the operation termination instruction is triggered by an alarm protection program to terminate the operating state of the fracturing pump 5; and the alarm protection program includes triggering the operation termination instruction in at least one of cases where the pressure of the lubricating oil of the fracturing pump 5 is less than a first predetermined value, the temperature of the lubricating oil of the fracturing pump 5 is greater than a second predetermined value, or the pressure of the lubricating oil of the speed reducer 2 is less than a third predetermined value. The alarm protection program may be a preset program.

When the fracturing pump 5 is in the operating state, the operation termination instruction may be triggered under two conditions: one is that the operation termination instruction is inputted manually according to the operation displacement requirement to terminate the operating state of the fracturing pump 5, so that the turbine engine 1 enters the idling state. The other one is to trigger the operation termination instruction according to the preset alarm protection program. In some embodiments, the operation termination instruction may be triggered by the conditions such as the low pressure of the lubricating oil of the fracturing pump, the high temperature of the lubricating oil of the fracturing pump, and the low pressure of the lubricating oil of the reduction gearbox.

As illustrated in FIG. 8, the operation method of the turbine fracturing device further includes: stopping the operation of the fracturing pump in response to an emergency stop instruction; the emergency stop instruction triggering the idling instruction; and triggering the emergency stop instruction includes at least one of triggering the emergency stop instruction by an emergency stop protection program or manually judging emergencies to trigger the emergency stop instruction on the premise that the emergency stop protection program is not triggered. The emergency stop protection program includes triggering the emergency stop instruction in at least one of cases where the pressure of the lubricating oil of the turbine engine 1 is less than a fourth predetermined value, a vibration amplitude of the turbine engine 1 is greater than a fifth predetermined value, or the exhaust temperature of the turbine engine 1 is greater than a sixth predetermined value. The emergency stop protection program may be a preset program.

In some embodiments, the emergency stop instructions are from two ways. One is to manually judge the emergencies to trigger the emergency stop instruction on the premise that the emergency stop protection program is not triggered, and further trigger the idling state; and the other one is to trigger the preset emergency stop protection program to keep the turbine fracturing device in an emergency stop state; and In some embodiments, the emergency stop instruction is triggered in at least one of cases where the pressure of the lubricating oil of the turbine engine is excessively low, the vibration amplitude of the turbine engine is excessively high, or the exhaust temperature of the turbine engine is excessively high, and the idling state is further triggered.

In some embodiments, the operation method of the turbine fracturing device further includes: stopping the operation in response to the stop instruction so that the turbine fracturing device is stopped, the stop instruction triggering the idling instruction.

When the operation is ended and the stop is needed, the stop instruction is inputted manually, the stop instruction triggers the idling instruction, and the turbine engine 1 enters the idling state; and the idling instruction triggers the brake operation, so that the turbine fracturing device is stopped.

As illustrated in FIG. 8, at least one of the overpressure instruction, the start instruction, the operation termination instruction, the stop instruction and the emergency stop instruction may trigger the idling instruction, and further trigger the brake operation.

The brake operation is triggered by the above idling instruction or brake instruction so as to realize the brake operation of the turbine fracturing device. In some embodiments, the idling instruction triggers the brake operation directly.

According to the operation method of the turbine fracturing device provided by the embodiments of the present disclosure, the idling instruction makes the turbine engine enter the idling state and triggers the brake operation, which is beneficial to the quick use and response of the turbine fracturing device and beneficial to the quick re-operation of the turbine fracturing device, thereby improving the operation reliability of the turbine engine and the reliability of a fracturing well site. The turbine fracturing device provided by the embodiments of the present disclosure has no clutch, and adopts the brake mechanism to perform the brake operation when the turbine engine is in the idling state.

Compared with the turbine fracturing device provided with a clutch, the turbine fracturing device provided with the brake mechanism has at least one of the following advantages.

(1) The clutch is complicated in structure, and it is troublesome to replace spare parts, especially vulnerable parts such as oil seals. The brake mechanism is simple in structure and convenient to install, and it is convenient to replace the brake plate of the brake mechanism.

(2) The clutch needs to be engaged and connected only at a low speed. If the clutch is disconnected, the clutch can be reconnected only after the speed of the turbine fracturing device is reduced; therefore, there are restrictions on the operation of the turbine fracturing device. While the engagement and disconnection of the brake mechanism have no requirement on the rotation speed.

(3) In the working state, the clutch must be in a connected state, and if the clutch is in failure, the field operation cannot be continued. However, in the working state, the brake operation is in the disconnected state, and if the brake mechanism is in failure, the normal operation of the turbine fracturing device is not affected.

(4) The brake operation is started in the start process. The start process may be judged automatically without determining the state of the turbine fracturing device, such as the engagement and separation judgment.

(5) The turbine fracturing device provided with the brake mechanism may determine whether to enter the idling state or the operating state as required. The turbine fracturing device may be started in advance, and may also be put into use at any time by switching the operating state and the idling state at any time. The turbine fracturing device provided with the clutch has an excessively long start process, which affects the quick use and response of the turbine fracturing device.

(6) It is only necessary to trigger the idling instruction and the brake operation after the overpressure, and it is unnecessary to trigger the stop instruction, so that the turbine fracturing device may be re-operated quickly.

(7) The brake operation needs to consume power, which may make the turbine fracturing device stopped under the load instead of transmitting the power to the rear end, so that the operation risk of the turbine engine and the risk of the well site may be reduced, and the operation reliability of the turbine engine and the reliability of the fracturing well site can be improved.

In some embodiments of the present disclosure, the first predetermined value, the second predetermined value, the third predetermined value, the fourth predetermined value, the fifth predetermined value, and the sixth predetermined value may be set according to requirements.

At least one embodiment of the present disclosure further provides a turbine fracturing device, which is operated by any one of the above operation methods.

In some embodiments, referring to FIG. 6 and FIG. 7, a speed reducer 2 includes a reduction gearbox 20. The speed reducer 2 is connected with a fracturing pump 5 through a transmission shaft 70. A brake mechanism includes a brake plate 61 and a brake block 62. The brake block 62 is arranged on the reduction gearbox 20. The brake plate 61 is connected with the transmission shaft 70. The transmission shaft 70 is an output shaft of the speed reducer 2. In some embodiments, the speed reducer 2 further includes a speed reduction mechanism located in the reduction gearbox 20. For example, the brake plate 61 rotates with the transmission shaft 70. In response to the idling instruction or the brake instruction or when the turbine engine 1 is in an idling state, the brake block 62 contacts the brake plate 61 to perform the brake operation so as to control a rotation speed of the transmission shaft 70 of the reduction gearbox 2, so that the rotation speed of the transmission shaft 70 is reduced, and the brake operation may make the rotation speed of the transmission shaft 70 become 0.

Figure 9:
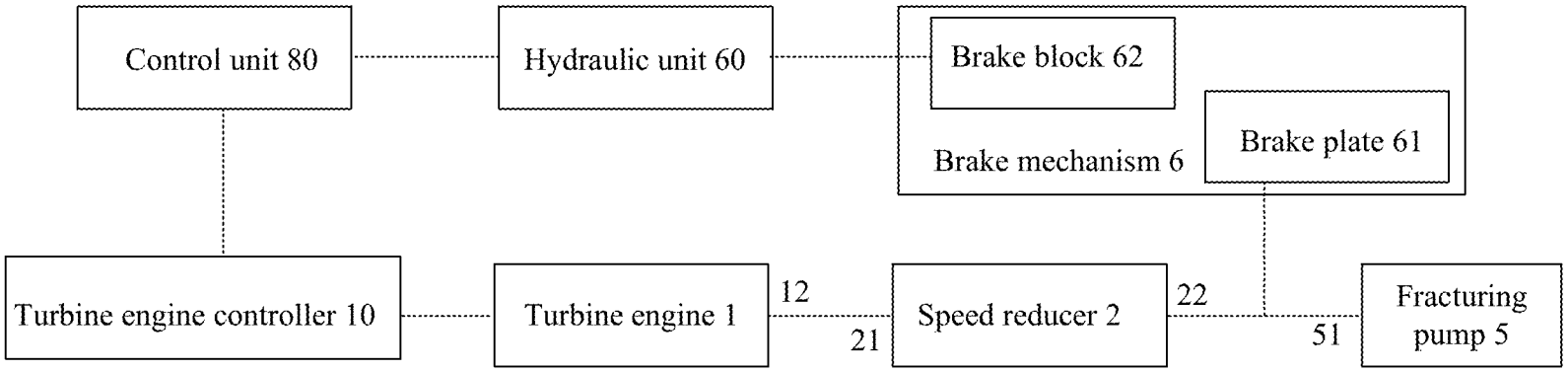
FIG. 9 is a schematic diagram of a turbine fracturing device provided by an embodiment of the present disclosure.

FIG. 9 is a schematic diagram of the turbine fracturing device provided by an embodiment of the present disclosure. As illustrated in FIG. 9, the brake block 62 is driven by a hydraulic unit 60. In some embodiments, in response to the idling instruction or the brake instruction, the hydraulic unit 60 controls the brake block 62 to perform brake. The hydraulic unit 60 controls the brake block 62 to move so as to contact and rub with the brake plate 61, thereby achieving a brake effect. In some embodiments, the hydraulic unit 60 includes a hydraulic pump, a hydraulic motor, and a control valve.

As illustrated in FIG. 9, the turbine fracturing device further includes a control unit 80. The control unit 80 controls the hydraulic unit 60 to drive the brake block 62.

As illustrated in FIG. 9, the turbine engine 1 includes an output shaft 12. The speed reducer 2 includes an input shaft 21 and an output shaft 22. The fracturing pump 5 includes an input shaft 51. As illustrated in FIG. 9, the output shaft 12 of the turbine engine 1 is connected with the input shaft 21 of the speed reducer 2. The output shaft 22 of the speed reducer 2 is connected with the input shaft 51 of the fracturing pump 5. In some embodiments, the output shaft 22 may be the above transmission shaft 70.

As illustrated in FIG. 9, the turbine fracturing device further includes a turbine engine controller 10. The control unit 80 is connected with the turbine engine controller 10 so as to control the rotation speed of the output shaft 12 of the turbine engine 1.

Figure 10:
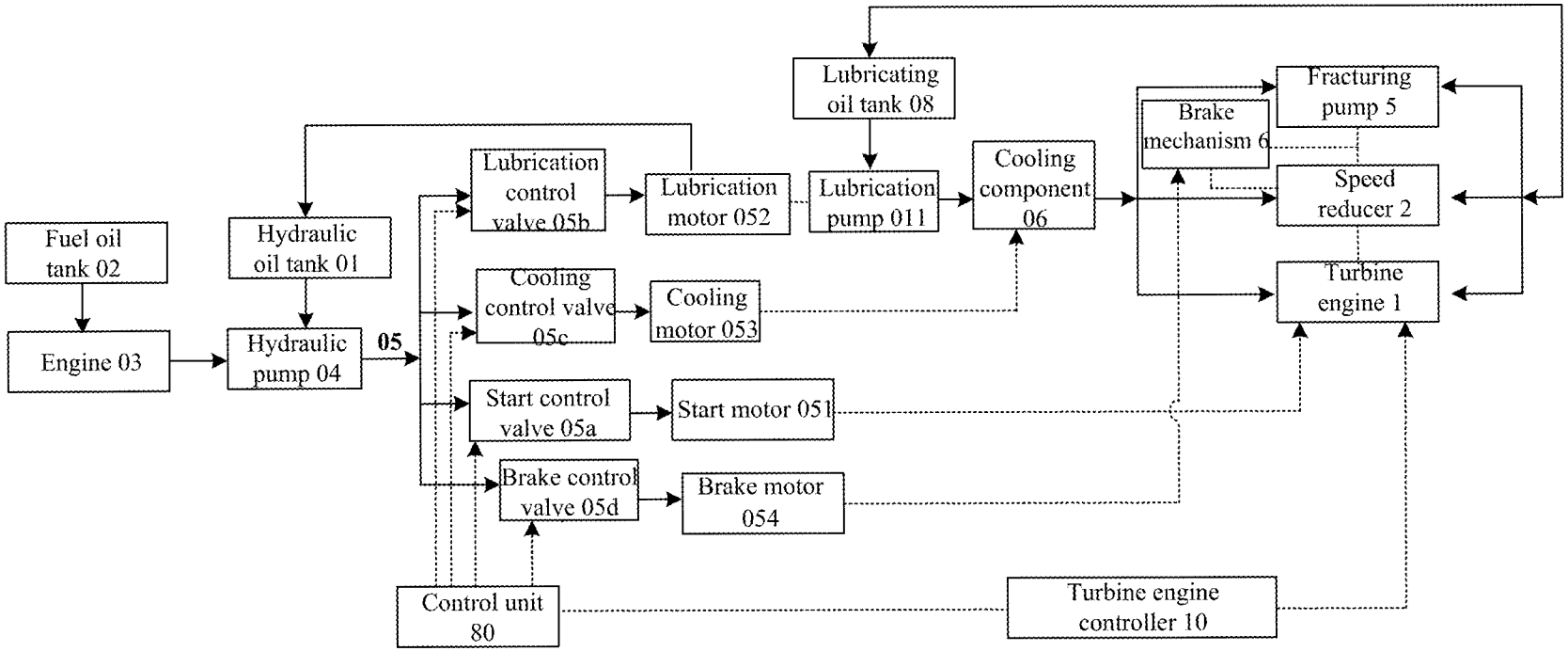
FIG. 10 is a schematic diagram of a turbine fracturing device provided by an embodiment of the present disclosure.

FIG. 10 is a schematic diagram of the turbine fracturing device provided by an embodiment of the present disclosure. As illustrated in FIG. 10, a solid line indicates hydraulic fluid, an arrow indicates a flowing direction of the hydraulic fluid, and a dotted line indicates mechanical connection between components.

As illustrated in FIG. 10, a fuel oil tank 02 supplies oil to an engine 03. The engine 03 is connected with a hydraulic pump 04. A hydraulic oil tank 01 is connected with the hydraulic pump 04.

As illustrated in FIG. 10, the hydraulic pump 04 supplies oil to an execution motor 05 of the turbine fracturing device. The execution motor 05 includes a start motor 051, a lubrication motor 052, a cooling motor 053, and a brake motor 054. The lubrication motor 052 is connected with a lubrication pump 011 so as to drive the lubrication pump 011 to transmit the lubricating oil from a lubricating oil tank 08 to the fracturing pump 5, the speed reducer 2, and the turbine engine 1 for lubrication.

As illustrated in FIG. 10, the cooling motor 053 drives a cooling component 06. The start motor 051 is connected with the turbine engine 2 to start the turbine engine 2. The brake motor 054 drives the brake mechanism 6.

The turbine fracturing device adopts an auxiliary engine as a power source to drive components such as lubricating component and cooling component of the whole equipment, and start component and gas supply component of the turbine engine.

As illustrated in FIG. 10, the turbine fracturing device includes a start control valve 05*a*, a lubrication control valve 05*b*, a cooling control valve 05*c*, and a brake control valve 05*d*.

As illustrated in FIG. 10, the control unit 80 is connected with the start control valve 05*a*, the lubrication control valve 05, the cooling control valve 05*c*, and the brake control valve 05*d*, respectively, to control the opening, closing and open degree of the corresponding control valves.

As illustrated in FIG. 10, the control unit 80 is connected with the turbine engine controller 10 to control the rotation speed of the output shaft 12 of the turbine engine 1.

FIG. 10 illustrates an example that the engine 03 of the hydraulic pump 04 is driven by fuel oil, and the start motor 051, the lubrication motor 052, the cooling motor 053 and the brake motor 054 are all hydraulic motors, but the turbine fracturing device provided by the embodiments of the present disclosure is not limited to the illustration of FIG. 10. In some embodiments, the hydraulic motor may also be replaced by an electric motor.

The turbine fracturing device provided by the embodiment of the present disclosure may further include one or more processors and one or more memories. The processor may process data signals and may include various computing architectures such as a complex instruction set computer (CISC) architecture, a reduced instruction set computer (RISC) architecture or an architecture for implementing a combination of multiple instruction sets. The memory may store instructions and/or data executed by the processor. The instructions and/or data may include codes which are configured to achieve some functions or all the functions of one or more devices in the embodiments of the present disclosure. For instance, the memory includes a dynamic random access memory (DRAM), a static random access memory (SRAM), a flash memory, an optical memory or other memories well known to those skilled in the art.

In some embodiments of the present disclosure, the control unit 80, and/or the turbine engine controller 10 include codes and programs stored in the memories; and the processors may execute the codes and the programs to achieve some functions or all the functions of the control unit 80, and/or the turbine engine controller 10.

In some embodiments of the present disclosure, the control unit 80, and/or the turbine engine controller 10 may be specialized hardware devices and configured to achieve some or all the functions of the control unit 80, and/or the turbine engine controller 10. For instance, the control unit 80, and/or the turbine engine controller 10 may be a circuit board or a combination of a plurality of circuit boards and configured to achieve the above functions. In embodiments of the present disclosure, the circuit board or a combination of the plurality of circuit boards may include: (1) one or more processors; (2) one or more non-transitory computer-readable memories connected with the processors; and (3) processor-executable firmware stored in the memories.

Since a turbine engine can directly use natural gas as fuel and has the advantages of small size, light weight, high power density, etc., driving by a turbine engine, compared to by a diesel engine, is conducive to reducing the size of the fracturing device and has the advantages of environmental protection, high driving efficiency, etc. Moreover, the power supply pressure in a fracturing operation site can be reduced when a turbine engine is used for driving compared to directly using an electric motor for driving. In addition, the turbine engine further has the advantages of small size, light weight, high power density and the like.

In another aspect, the turbine engine generates power through the rotation of an impeller driven by a fluid. Therefore, it is necessary to keep the impeller and blades of the turbine engine clean and prevent device breakdown due to disruption in the balance of the impeller or damage of the impeller caused by impurities.

At least one embodiment of the present disclosure provides a fracturing device which includes a power unit. The power unit includes a muffling compartment, a turbine engine, an air intake unit and a cleaner. The air intake unit is communicated with the turbine engine through an intake pipe and is configured to provide a combustion-supporting gas to the turbine engine. The cleaner is configured to clean the turbine engine. The air intake unit is located at the top of the muffling compartment, and the muffling compartment has an accommodation space. The turbine engine and the cleaner are located within the accommodation space. The cleaner is located at the side, away from the air intake unit, of the turbine engine.

The fracturing device according to at least one embodiment of the present disclosure can facilitate the air intake unit to take in air by disposing the air intake unit above (at the top of) the turbine engine, and meanwhile can realize a compact structure by disposing the cleaner below the turbine engine to arrange the fracturing device in three layers (i.e. upper, middle and lower layers), which thus reduces the size of the fracturing device and facilitates transportation. In addition, the turbine engine is disposed in the muffling compartment, which is conducive to noise reduction.

The term "below" as used in this embodiment of the present disclosure is not necessarily about being "directly below" and may also mean "obliquely below".

In at least one embodiment, the cleaner is directly driven by electric power, i.e., by an electric motor, so that the space occupied by the cleaner can be effectively reduced, and it is convenient to place the cleaner below the turbine engine. In some embodiments, the highest point of the cleaner is below the lowest point of the turbine engine. Such an arrangement may prevent the cleaner from shielding the turbine engine in the height direction, thereby facilitating the maintenance of the turbine engine.

In another examples, the cleaner may also be driven pneumatically or hydraulically. The driving mode of the cleaner is not limited by the embodiments of the present disclosure.

Figure 11:
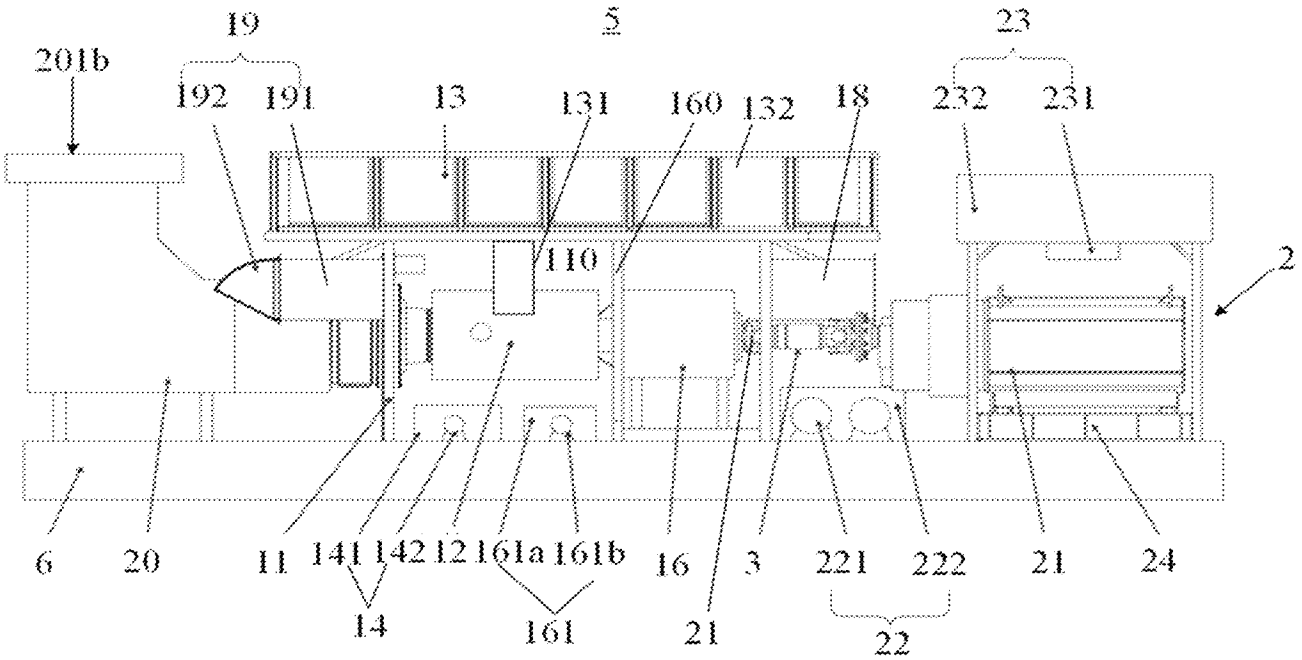
FIG. 11 is a structural schematic diagram of a fracturing device according to at least one embodiment of the present disclosure.

FIG. 11 is a side-view structural schematic diagram of a fracturing device according to at least one embodiment of the present disclosure.

As shown in FIG. 11, the fracturing device 5 includes a power unit 1. The power unit 1 includes a muffling compartment 11, a turbine engine 12, an air intake unit 13 and a cleaner 14.

The muffling compartment 11 has an accommodation space 110, and the turbine engine 12 and the cleaner 14 are located within the accommodation space 110. In some embodiments, a muffler such as soundproof sponge or a muffler plate is disposed on the inner wall of the muffling compartment.

The air intake unit 13 is located at the top of the muffling compartment 11 and communicated with the turbine engine 12 through an intake pipe 131, and the air intake unit 13 is configured to provide a combustion-supporting gas to the turbine engine 12. In some embodiments, the air intake unit 13 includes an intake filter and an intake muffler, and the intake muffler has one end connected to the intake filter and another end communicated with the intake pipe 131.

In some embodiments, the air intake unit 13 comprises a plurality of intake cabins 132 arranged side by side. The plurality of intake cabins 132 help to enlarge the size of the air intake unit 13, thus providing a high gas capacity to increase the power of the turbine engine 12. The intake cabins 132 also help to reduce the resistance of air intake and exhaust, thereby being conducive to prolonging the service life of the turbine engine.

In some embodiments, the air intake unit 13 extends beyond the range of the muffling compartment 11 in the axial direction of the turbine engine, helping to enlarge the size of the intake cabins and protect (e.g., keep out the rain) the structure (e.g., an air inlet assembly and an air outlet assembly as described below) thereunder. It should be noted that the mentioned axial direction of the turbine engine may be the extension direction of a transmission shaft or an output shaft in the turbine engine.

The air intake unit 13 is fixed to the top of the muffling compartment 11, for example, by welding.

In some embodiments, the cleaner 14 is located at the side, away from the air intake unit 13, of the turbine engine 12, i.e., below the turbine engine. In some embodiments, the cleaner 14 may be located directly or obliquely below the turbine engine 12. The cleaner 14 may include a water tank 141 and a cleaning pump 142. The cleaner 14 may be electrically driven, and the space used by the cleaner can thus be reduced. In another examples, the cleaner may be driven by an air compressor which may be located outside the muffling compartment. The air compressor may be driven electrically. In further another examples, the cleaner may be driven by a hydraulic system which may be driven electrically.

In some embodiments, the power unit 1 further includes a starter located within the muffling compartment 11 and configured to start the turbine engine 12.

In some embodiments, the starter includes an electric motor. The electric motor is configured to directly start the turbine engine 12, i.e., the turbine engine is started electrically. IAs shown in FIG. 12, the starter 121 is integrated into the turbine engine.

The electric power needed to start the turbine engine is far less than that directly used to drive a fracturing pump unit, thus reducing the power supply demand in the fracturing work site.

In another examples, the turbine engine 12 includes a hydraulic system. The electric motor in the starter is configured to drive the hydraulic system to start the turbine engine, i.e., the hydraulic system is driven electrically. In some embodiments, the electric motor is located at the side, away from the air intake unit, of the turbine engine 12.

Compared with a diesel-driven hydraulic system, the electric motor takes up only small space and thus can be placed below the turbine engine.

In some embodiments, the hydraulic system includes a hydraulic pump, a hydraulic motor, various valves, a hydraulic oil reservoir, a hydraulic oil radiator, etc. The hydraulic system is configured to be driven by the electric motor to drive a fuel pump, a starting motor and so on of the turbine engine 12, thereby starting the turbine engine 12.

Figure 12:
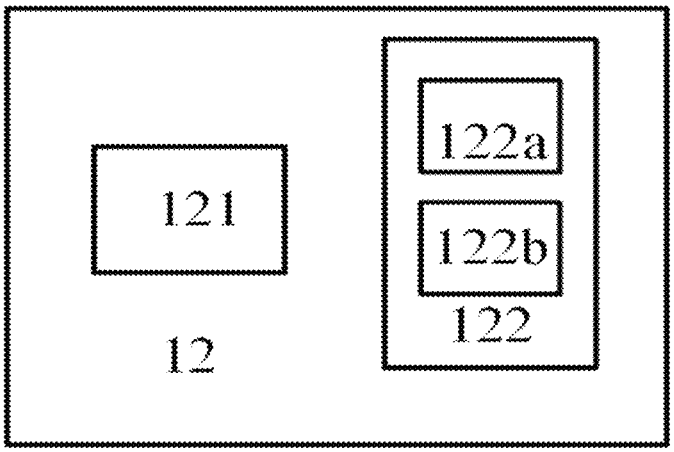
FIG. 12 is a structural schematic diagram of a turbine engine according to at least one embodiment of the present disclosure.

In some embodiments, the power unit further includes a first lubricating system 122 configured to lubricate the turbine engine 12. FIG. 12 schematically shows a diagram of the turbine engine 12. As shown in FIG. 12, the first lubricating system 122 is integrated into the turbine engine 12.

The first lubricating system 122 includes a first lubricating oil reservoir 122*a* and a first driving mechanism 122*b*. The first driving mechanism includes an electric motor, that is, the first lubricating system is driven electrically.

In some embodiments, as shown in FIG. 11, the power unit 1 further includes a deceleration mechanism 16 and a second lubricating system 161 which are located within the muffling compartment 11. The second lubricating system 161 is configured to lubricate the deceleration mechanism 16. The deceleration mechanism 16 is connected to an output shaft of the turbine engine 12, and the deceleration mechanism 16 and the turbine engine 12 are arranged along the axial direction of the turbine engine 12.

The second lubricating system 161 includes a second lubricating oil reservoir 161*a* and a second driving mechanism 161*b*. The second driving mechanism 161*b* includes an electric motor, i.e., the second lubricating system 161 is driven electrically and thus can have a small size.

In some embodiments, as shown in FIG. 11, the second lubricating system 161 is located at the side, away from the air intake unit 13, of the turbine engine 12, for example, below the turbine engine 12. In some embodiments, the second lubricating system 16 and the cleaner 14 are arranged along the axial direction of the turbine engine 12, and the second lubricating system 16 is closer to the deceleration mechanism 16 than the cleaner 14, thus facilitating the lubrication of the deceleration mechanism 16 by the second lubricating system 161.

The muffling compartment is a relatively closed cabin. The operation of the turbine engine 12 can easily result in a high temperature or natural gas leakage within the muffling compartment and the danger is concealed, which may result in lagging danger judgment in human inspection without reliable guarantee for the safety of the personnel and the device.

In some embodiments, the power unit 1 further includes a firefighting system. The firefighting system may realize advance warning on the danger within the muffling compartment. Moreover, in at least one example, the firefighting system may automatically extinguish fire within the muffling compartment 11, thus greatly improving the reliability of device operation and the safety of the personnel.

Figure 13A:
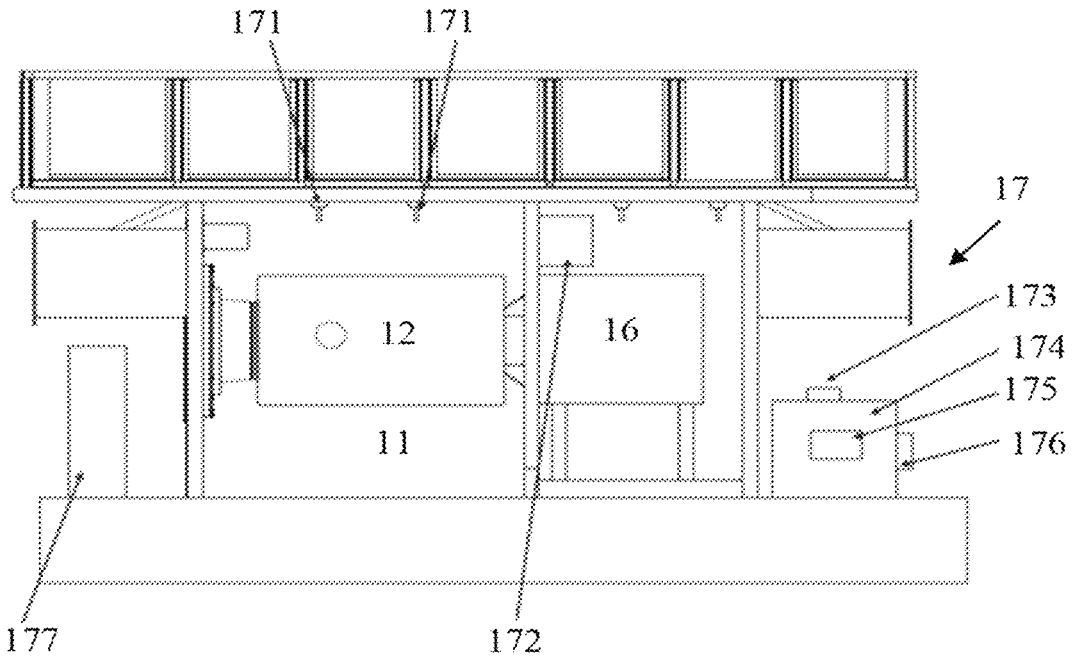
FIG. 13A is a structural schematic diagram of a firefighting system according to at least one embodiment of the present disclosure.

FIG. 13A is a schematic diagram of a firefighting system according to at least some embodiments of the present disclosure. For the sake of clarity, some components of the fracturing device are omitted from FIG. 13A.

As shown in FIG. 13A, the firefighting system 17 includes at least one firefighting detector 171 and a firefighting material generator 172 which are located within the muffling compartment 11. The firefighting detectors 171 may include, but not be limited to, a temperature detector, a smoke detector, a flame detector, a combustible gas detector, etc. In the case where a plurality of types of firefighting detectors are used, the number of the firefighting detector of each type would not be limited too.

The firefighting material generator 172 is filled with a firefighting material. In some embodiments, the firefighting material may include an aerosol. Compared with the traditional dry powder material, the aerosol in an equal volume can have a better fire extinguishing performance. Therefore, a container for the aerosol needs a smaller space and thus can be easily disposed within the muffling compartment 11.

As shown in FIG. 13A, the firefighting system 17 includes a plurality of firefighting detectors 171 disposed at the top of the muffling compartment 11 for detection at different positions within the muffling compartment 11. The firefighting detectors 171 are disposed directly above the turbine engine 12 and the deceleration mechanism 16, respectively. The firefighting detectors 171 can be the same or different in type. The firefighting material generator 172 is disposed on a support column 160 between the turbine engine 171 and the deceleration mechanism 16.

In some embodiments, the firefighting system 17 further includes an alertor 173, a controller 174, a firefighting monitor 175 and an emergency switch 176 which are located outside the muffling compartment 11. The controller 174 is in signal connection (e.g., communication connection) with the alertor 173, the turbine engine 171 and the firefighting material generator 172 respectively. In the case where an anomaly (e.g., that at least one of temperature, smoke consistency, combustible gas concentration in the muffling compartment 11 is above a threshold value, or a flame is generated) is detected by the firefighting detector 171, the controller 174 is triggered to control the firefighting material generator 172 to start automatically and eject the firefighting material and simultaneously control the alertor 173 to give an alerting signal.

In some embodiments, the firefighting system 17 further includes a hand fire extinguisher 177 located outside the muffling compartment, allowing the personnel on the spot to extinguish fire manually. The hand fire extinguisher 177 may be a dry powder fire extinguisher.

Figure 13B:
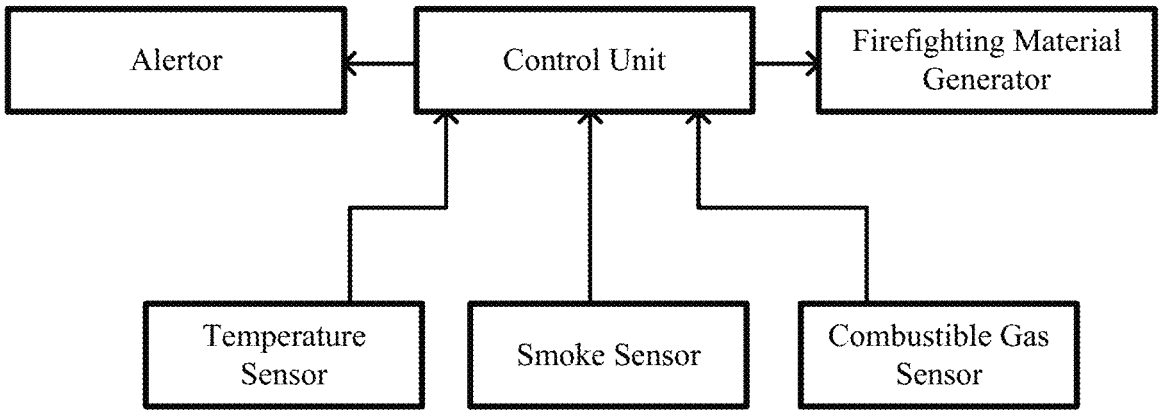
FIG. 13B is a structural schematic diagram of a firefighting system according to some other embodiments of the present disclosure.

FIG. 13B is a schematic diagram of a firefighting system in a fracturing device according to other examples of the present disclosure. As shown in FIG. 13B, the firefighting system includes a control unit, an alertor, a firefighting material generator, a plurality of temperature sensors, a plurality of smoke sensors and a plurality of combustible gas sensors. The control unit is in signal connection with the alertor, the firefighting material generator, the temperature sensors, the smoke sensors and the combustible gas sensors respectively.

In some embodiments, the control unit is configured to control the plurality of temperature sensors to detect the temperature simultaneously at different positions within the compartment of the turbine engine and generate a temperature data set from the obtained temperature data. The operation is repeated cyclically, and the temperature data sets are output, thus realizing the detection of the temperature in the compartment.

In some embodiments, the control unit is further configured to control the plurality of smoke detectors to detect the smoke simultaneously at different positions within the compartment of the turbine engine and generate a smoke data set from the obtained smoke data. The operation is repeated cyclically, and the smoke data sets are output, thus realizing the detection of the smoke in the compartment.

For example, the control unit is further configured to control the plurality of combustible gas sensors to detect the concentration of the combustible gas simultaneously at different positions within the compartment of the turbine engine and generate a combustible gas data set from the obtained combustible gas concentration data. The operation is repeated cyclically, and the combustible gas data sets are output, thus realizing the detection of the combustible gas in the compartment. The combustible gas may include methane.

In some embodiments, the control unit is further configured to, in response to a preset temperature threshold value, cyclically determine whether more than half of temperature data in the temperature data sets is above the temperature threshold value, output fire information if yes, and output alert information if no, where the alert information contains the temperature data of the temperature above the temperature threshold value and detection positions thereof.

In some embodiments, the control unit is further configured to, in response to a smoke threshold value input from the outside, cyclically determine whether more than half of smoke data in the smoke data sets is above the smoke threshold value, output fire information if yes, and output alert information if no, where the alert information contains the smoke data of the smoke above the smoke threshold value and detection positions thereof.

In some embodiments, the control unit is further configured to, in response to a combustible gas concentration threshold value input from the outside, cyclically determine whether more than half of combustible gas concentration data in the combustible gas data sets is above the combustible gas concentration threshold value, output warning information if yes, and output alert information if no, where the alert information contains the values of combustible gas concentration above the combustible gas concentration threshold value and detection positions thereof.

In some embodiments, the control unit is further configured to, in response to the fire information, trigger the firefighting material generator to perform firefighting operation including ejecting aerosol, carbon dioxide, etc., and simultaneously trigger the alertor to give an alerting signal, for example, a sound signal and/or a light signal. In some embodiments, the firefighting material generator includes a sprinkler having structures such as a nozzle, a liquid reservoir and a pipe.

In some embodiments, the control unit is further configured to recheck the detection of the combustible gas to improve the detection accuracy. The control unit is configured to, in response to the fire information, determine whether the warning information is received simultaneously, carry out no operation if yes, and if no, generate an anomaly set from all combustible gas concentration data of combustible gas concentration below a combustible gas concentration threshold value and the detection positions thereof, and output the anomaly set.

The firefighting system can recheck and calibrate the combustible gas concentration sensors based on the temperature sensors and the smoke sensors and avoid disfunction of the equipment and further improve the fire safety performance of the equipment.

As shown in FIG. 11, the power unit 1 further includes an air inlet assembly 18 and an air outlet assembly 19. The air inlet assembly 18 is located at one side of the turbine engine along the axial direction of the turbine engine and is communicated with the accommodation space of the muffling compartment 12. The air outlet assembly 19 is located at the other side of the turbine engine along the axial direction and disposed opposite to the air inlet assembly 8, and the air outlet assembly 19 is communicated with the accommodation space of the muffling compartment 12. The air inlet assembly 18 and the air outlet assembly 19 are configured to create a circulation environment in the muffling compartment, helping to dissipate heat from the compartment.

Figure 14A:
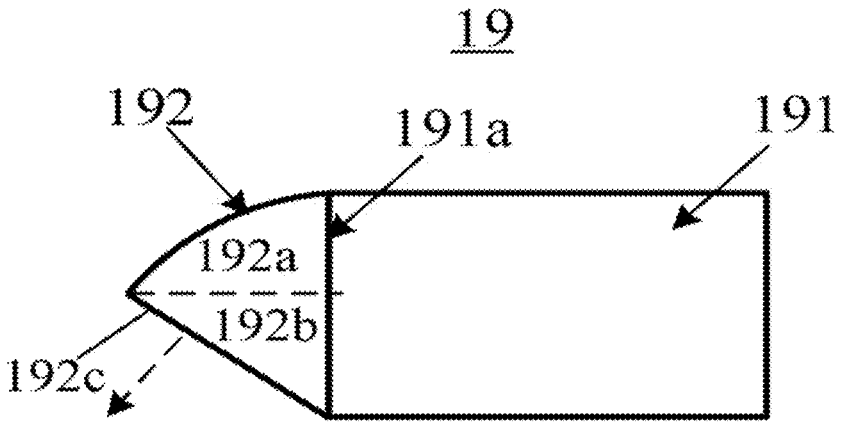
FIG. 14A is a structural schematic diagram of an air outlet assembly according to at least one embodiment of the present disclosure.

FIG. 14A shows an enlarged schematic diagram of the air outlet assembly 19. As shown in FIG. 14A, the air outlet assembly 19 includes an air outlet pipe 191 and a lead-out portion 192 connected to the air outlet pipe 191. The lead-out portion is configured to change an orientation of an air outlet 192*c* of the air outlet assembly, thereby effectively reducing sand wind that may enter the muffling compartment via the air outlet assembly to cause damage to the materials in the compartment.

In some embodiments, during loading or transportation of the fracturing device, the air outlet assembly 19 is generally closer to the front, namely the truck head, in the direction of transportation, while the air inlet assembly 18 is closer to the back, namely the truck tail. Thus, the fracturing device can be conveniently unloaded to carry out fracturing work after arriving at the work site. Consequently, during transportation, sand wind can easily get into the muffling compartment via the air outlet assembly 19.

As shown in FIG. 14A, the lead-out portion 192 is provided to change the orientation of the air outlet 192*c* of the air outlet assembly 19 from being horizontally forward (i.e., along the moving direction) to being obliquely downward, thus effectively reducing sand wind entering. The orientation of the air outlet 192*c* of the air outlet assembly 19 is shown by the dotted arrow in FIG. 14A. However, the orientation of the air outlet of the air outlet assembly with the lead-out portion is not limited in the embodiments of the present disclosure. In another examples, the air outlet 192*c* may be upward or oriented laterally, which is not limited in the embodiments of the present disclosure. The lead-out portion 192 is rotatably connected to the air outlet pipe 191, and the orientation of the air outlet of the air outlet assembly 19 can be changed by rotating the lead-out portion 192.

As shown in FIG. 14A, the lead-out portion 192 is in the shape of an elbow and has a cone-shaped section with a cone angle of 40°-60° (e.g., 45°).

As shown in FIG. 14A, the lead-out portion 192 includes a shielding portion 192*a* and an air outlet portion 192*b*. The shielding portion 192*a* is configured to shield an air outlet 191*a* of the air outlet pipe 191 to keep out the external sand wind. The air outlet portion 192*b* is configured to exhaust the gas that flows from the air outlet pipe 191 into the lead-out portion 192. The dividing line between the shielding portion 192*a* and the air outlet portion 192*b* is shown by the dotted line perpendicular to the air outlet 191*a* of the air outlet pipe 191 in FIG. 14A, which actually is not necessarily present.

In some embodiments, the orthographic projection of the shielding portion 192*a* on the plane where the air outlet 191*a* of the air outlet pipe 191 is positioned is at least partially overlapped with the air outlet 191*a* for shielding, with an overlapping area greater than 30% of the area of the air outlet to realize effective shielding.

The lead-out portion 192 is structurally designed to realize shielding, which does not need extra power or control.

Figure 14B:
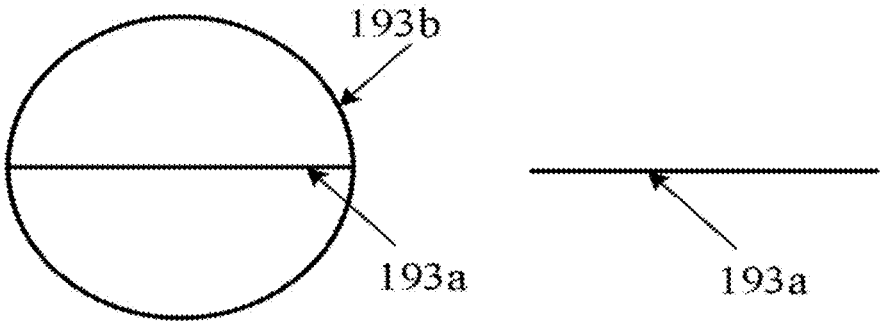
FIG. 14B is a structural schematic diagram of an air outlet portion according to at least one embodiment of the present disclosure.

In some embodiments, as shown in FIG. 14B, the air outlet portion 192*b* may include a revolving shaft 193*a* and a blade 193*b* disposed on the revolving shaft 193*a*. The blade 193*b* is capable of rotating around the revolving shaft under the action of an external force. In some embodiments, the revolving shaft and the blade are located at the air outlet of the air outlet portion. By rotating the blade, the air outlet portion can be opened and closed. In some embodiments, the air outlet portion may be closed during transportation and may be opened during fracturing. FIG. 14B shows a schematic diagram of the revolving shaft and the blade when the air outlet portion is closed (on the left of FIG. 14B) and opened (on the right of FIG. 14B) respectively in a direction perpendicular to the air outlet surface of the air outlet portion 192*b*.

Figure 15A:
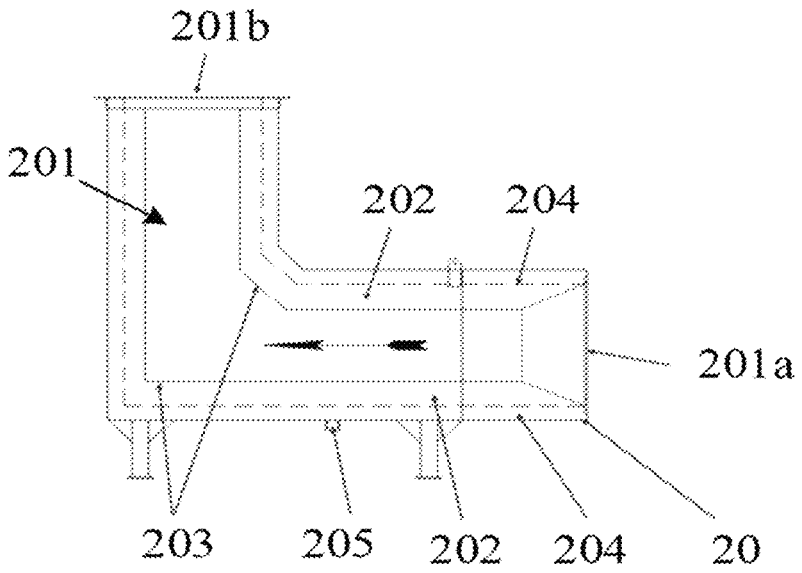
FIG. 15A is a structural schematic diagram of an exhaust muffler according to at least one embodiment of the present disclosure.

In some embodiments, the power unit further includes an exhaust muffler which is communicated with the turbine engine 12 through an exhaust pipe and configured to allow the gas from the turbine engine 12 to be exhausted into the atmosphere after being muffled and deflected. FIG. 15A shows a structural schematic diagram of an exhaust muffler according to at least one embodiment of the present disclosure.

As shown in FIG. 15A, the exhaust muffler 20 includes an L-shaped gas delivery pipe 201. The L-shaped gas delivery pipe 201 has an intake port 201*a* at one end, and the intake port 201*a* is communicated with the turbine engine 12 through an exhaust pipe for gas intake, and the gas delivery pipe 201 has an upward exhaust port 201*b* at the other end, so as to exhaust the gas from the turbine engine to the atmosphere. The direction of gas delivery is shown by the arrow in FIG. 15A.

The exhaust muffler 20 further includes a muffling layer 202 disposed on the inner wall of the gas delivery pipe 201 to serve for muffling. Noise generated during gas delivery can be effectively reduced when the gas in the gas delivery pipe 201 is in contact with the muffling layer 202. In some embodiments, the muffling layer 202 includes soundproof sponge.

In some embodiments, the exhaust muffler 20 further includes a perforated muffler plate 203 located on the inner wall of the muffling layer 202. The perforated muffler plate 203 has holes to allow the gas in the delivery pipe 201 to be in contact with the muffling layer 202 for muffling.

Figure 15B:
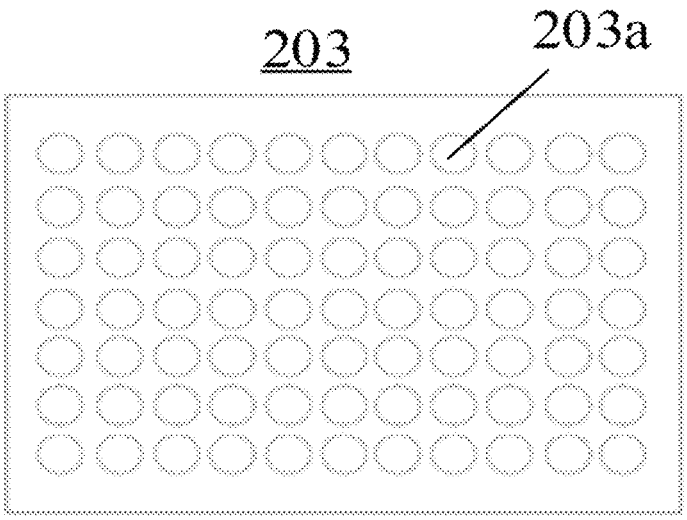
FIG. 15B is a structural schematic diagram of an exhaust muffler plate according to at least one embodiment of the present disclosure.

FIG. 15B shows a structural schematic diagram of the perforated muffler plate 203. The perforated muffler plate 203 may be tubular, and FIG. 15B shows a partial schematic diagram of the perforated muffler plate 203.

The perforated muffler plate 203 has a plurality of muffling holes 203*a* arranged in an array. Thus, the gas can be brought into full contact with the perforated muffler plate, and the muffling effect can be enhanced by collision between the gas and the hole walls of the perforated muffler plate 203. In some embodiments, the muffling hole 203*a* has a radius of 2-8 mm. The planar shape of the muffling hole is not limited in the embodiments of the present disclosure. The planar shape of the muffling hole may be elongated round, oval, square, diamond, etc.

As shown in FIG. 15A, the intake port 201*a* of the exhaust muffler 20 has a retracted structure. The inner diameter of the retracted structure is gradually reduced along the intake direction. The space undergoes contraction when the exhaust gas enters the gas delivery pipe 201, so that the gas flow direction changes rapidly, thereby improving the muffling effect.

As shown in FIG. 15A, the exhaust muffler 20 further includes a thermal insulating layer 204 located between the inner wall of the exhaust muffler 20 and the muffling layer 202 to prevent a housing of the exhaust muffler from being too hot. In some embodiments, the thermal insulation design is necessary because the temperature of the exhaust gas from the turbine engine is up to 600° C.

In some embodiments, the exhaust muffler 20 further includes a water port 205 located in the bottom. When water flows into the exhaust muffler 20, the water can be drained through the perforated muffler plate 203 and finally discharged via the water port 205.

The exhaust muffler 20 shown in FIG. 15A keeps the gas delivery pipe unblocked while serving for muffling, thus reducing the exhaust resistance and improving the exhaust efficiency.

Figure 15C:
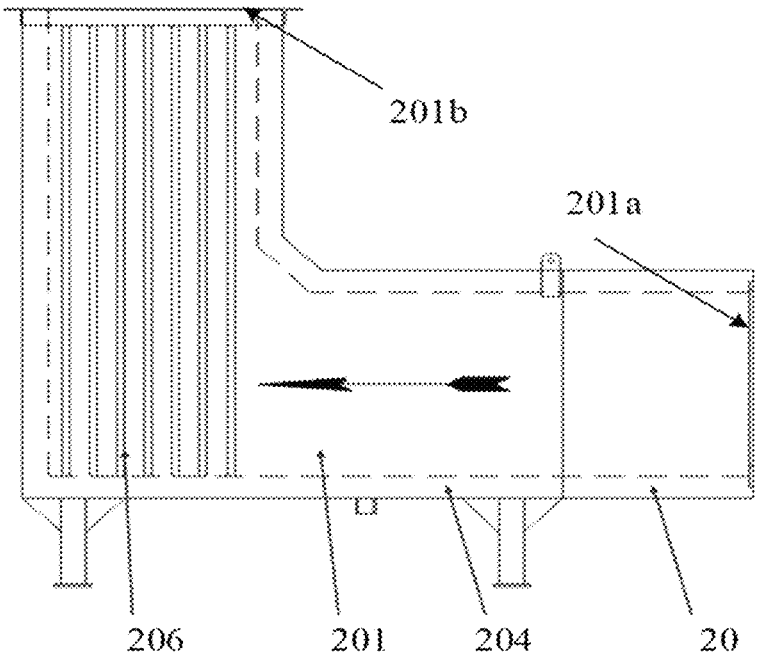
FIG. 15C is a structural schematic diagram of an exhaust muffler according to some other embodiments of the present disclosure.

FIG. 15C is a structural schematic diagram of an exhaust muffler according to other embodiments of the present disclosure. As shown in FIG. 15C, the exhaust muffler 20 differs from the embodiment shown in FIG. 15A in that the exhaust muffler 20 includes a muffling barrier 206 to realize the noise reduction function by increasing the exhaust resistance. In some embodiments, the muffling barrier 206 may include a heat-resisting material to absorb noise. In some embodiments, the heat-resisting material is soundproof sponge. The muffling barrier 206 is disposed in a branch, close to the exhaust port 201*b*, of the gas delivery pipe 201, and the exhaust gas entering the pipe arrives at the exhaust port 201*b* through the muffling barrier 206.

In some embodiments, the air outlet of the lead-out portion 192 of the air outlet assembly 19 is oriented towards the outer surface of the exhaust muffler 20, so that the surface of the exhaust muffler is cooled by the exhaust gas from the air outlet assembly 19, thus realizing effective utilization of the exhaust gas.

As shown in FIG. 11, the fracturing device 5 further includes a fracturing pump unit 2. The fracturing pump unit 2 includes a fracturing pump 21 which may be a plunger pump. The fracturing device 5 further includes a transmission mechanism 3. In some embodiments, the transmission mechanism 3 includes a coupling. The coupling may be in the form of a flexible coupling, a transmission shaft, a clutch, etc.

The fracturing pump unit 2 is connected to the power unit 1 through the transmission mechanism 3, and the power unit 1 is configured to drive the fracturing pump 21 to carry out fracturing work. The turbine engine 12, the transmission mechanism 3 and the fracturing pump 21 are disposed in the axial direction of the turbine engine in sequence, for example, coaxially, thus improving the transmission efficiency.

Figure 16:
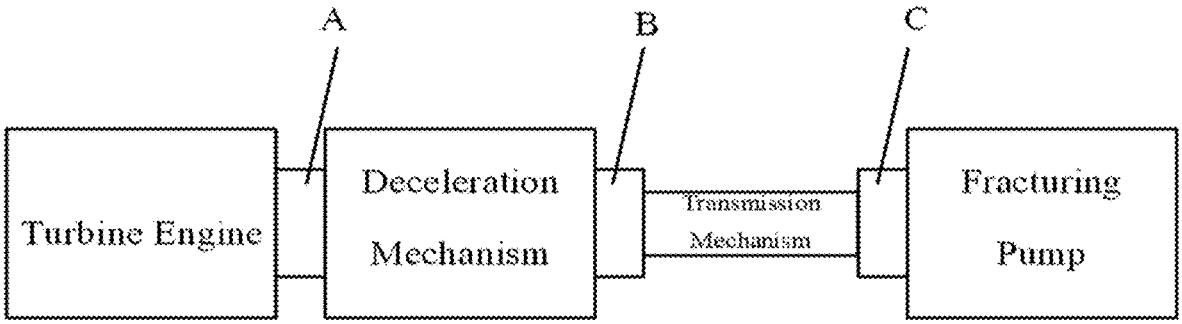
FIG. 16 is a schematic diagram of a fracturing device according to some other embodiments of the present disclosure.

FIG. 16 is a schematic diagram of a fracturing device according to at least one embodiment of the present disclosure. As shown in FIG. 16, the turbine engine, the deceleration mechanism, the transmission mechanism and the fracturing pump are disposed in the axial direction of the turbine engine in sequence, for example, coaxially, thus improving the transmission efficiency.

In some embodiments, the fracturing device may further include a brake mechanism disposed between the turbine engine and the fracturing pump, thus realizing power cutoff between the fracturing pump and the turbine engine. When the turbine engine is started, the speed is initially not high enough, and the brake mechanism may be started to prevent the pump from being driven and affecting the fracturing effect. The brake mechanism may include a brake block, a brake caliper, etc.

As shown in FIG. 16, the brake mechanism may be disposed at any one or more of the position between the turbine engine and the deceleration mechanism (i.e., position A), the position between the deceleration mechanism and the transmission mechanism (i.e., position B) and the position between the transmission mechanism and the fracturing pump (i.e., position C), finally realizing cutoff between power input and output. As shown in FIG. 11, the brake mechanism may be located between the deceleration mechanism 16 and the transmission mechanism 3 or integrated into the deceleration mechanism 16, providing a more compact integrated structure.

As shown in FIG. 11, the fracturing pump unit 2 further includes a third lubricating system 22 which is configured to lubricate the fracturing pump 21. The third lubricating system 22 includes an electric motor 221 and is located at the side, away from the air intake unit 13, of the transmission mechanism 3. The third lubricating system 22 further includes a lubricating oil reservoir 222.

In some embodiments, as shown in FIG. 11, the third lubricating system 22 is located below the transmission mechanism 3, thus saving space.

In some embodiments, as shown in FIG. 11, the fracturing pump unit 2 further includes a lubricating oil heat sink 23 which is configured to cool the third lubricating system 22. The lubricating oil heat sink 23 is located above the fracturing pump 21, i.e., at the side, away from a base of the fracturing pump 21, of the fracturing pump 21. The lubricating oil heat sink 23 may include an electric motor 231 and a radiator 232.

The lubricating oil heat sink 23 and the fracturing pump 21 are arranged longitudinally, providing a more compact structure.

In some embodiments, the fracturing pump unit 2 further includes a fracturing pump base 24 located below the fracturing pump 21 (i.e., at the side away from the air intake unit 13). The fracturing pump base 24 is configured to bolster the fracturing pump 21, so that the fracturing pump 21 and the turbine engine 12 are linearly arranged in the axial direction of the turbine engine 12, thus improving the transmission efficiency.

In some embodiments, as shown in FIG. 11, the fracturing device 5 further includes a bottom skid 6. The power unit 1 and the pump unit 2 are mounted on the bottom skid 6 to be fixed.

In the example as shown in FIG. 11, the fracturing device 5 is a skid-mounted device. However, this is not limited in the embodiments of the present disclosure. In another examples, the fracturing device 5 may also be a vehicle-mounted device or a semitrailer mounted device.

Figure 17A:
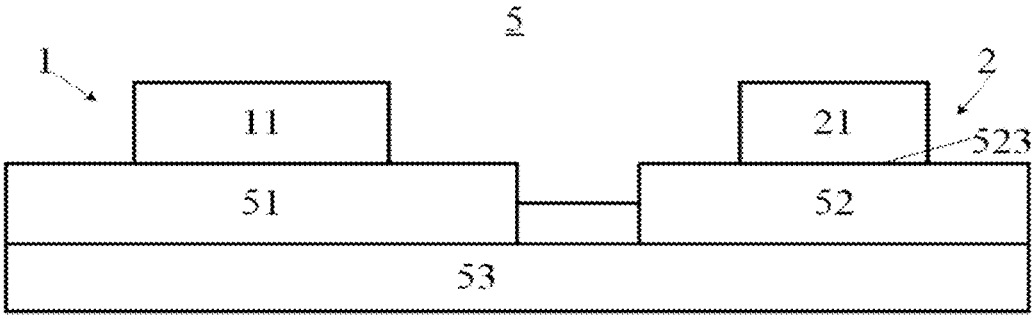
FIG. 17A is a structural schematic diagram of a fracturing device according to still other embodiments of the present disclosure.

FIG. 17A is a schematic diagram of a fracturing device according to other embodiments of the present disclosure. As shown in FIG. 17A, the power unit 1 further includes a power skid 51. The muffling compartment 11 is mounted on the power skid 51 to be fixed. The pump unit 2 further includes a pump skid 52. The pump skid 52 has a bearing surface 523, and the fracturing pump 21 is mounted on the bearing surface 523 of the pump skid 52 to be fixed. Control circuits and circuit traces for the power unit 1 are disposed on the power skid 51 and control circuits and circuit traces for the pump unit 2 are disposed on the pump skid 52.

The forms of the power skid and the pump skid are not limited in the embodiments of the present disclosure. The power skid/pump skid may merely include a bottom structure or may include a bottom structure and a cage structure extending upwards. The cage structure is configured to further fix the unit mounted on the bottom structure.

In some embodiments, the power skid 51 and the pump skid 52 are detachably connected to facilitate transportation. The connection manner of the power skid 51 and the pump skid 52 is not limited in the embodiments of the present disclosure. The two skids may be connected through a fastener, a connecting plate, etc.

In some embodiments, the power skid 51 and the pump skid 52 may be connected through a lug plate. One of the power skid 51 and the pump skid 52 has a single-lug plate, while the other one has a double-lug plate, and the two plates are connected through a pin shaft.

Figure 17B:
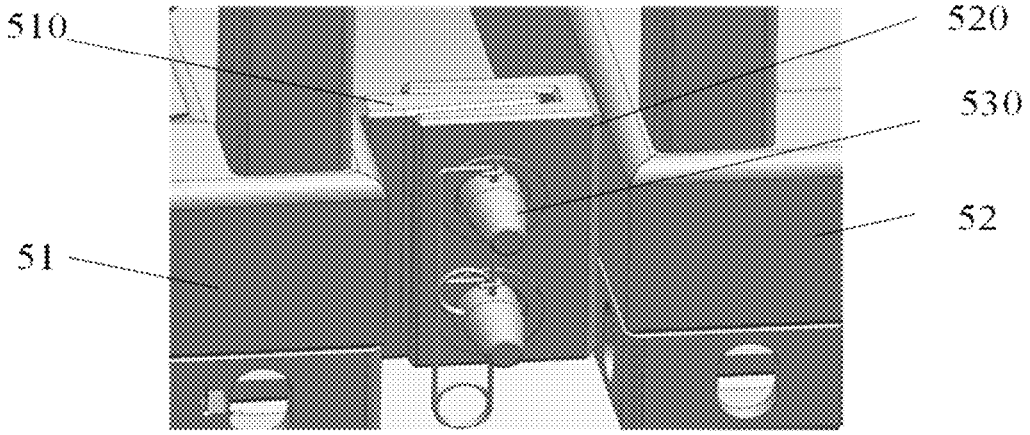
FIG. 17B and FIG. 17C are structural schematic diagrams of a fracturing device according to further still other embodiments of the present disclosure.
Figure 17C:
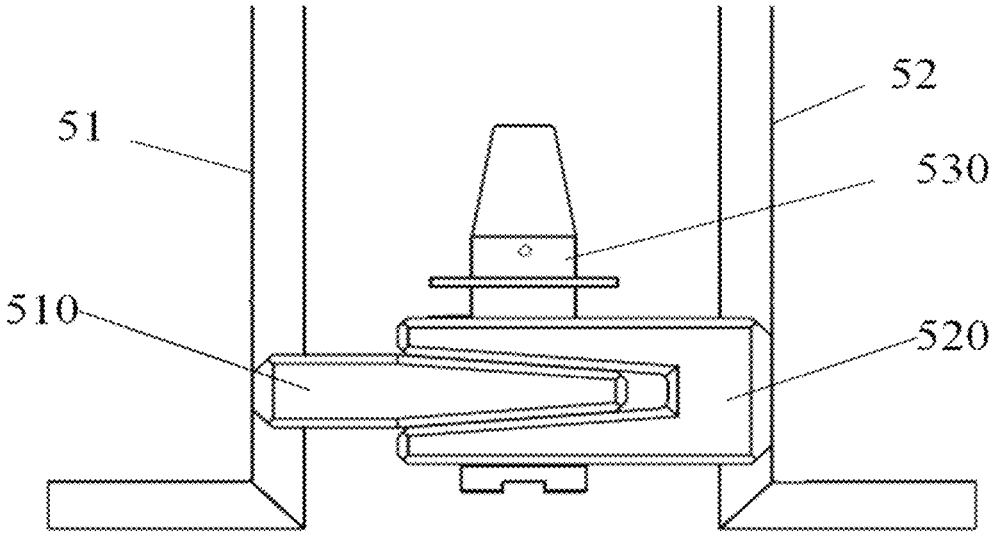

FIG. 17B shows a three-dimensional diagram of the connection between the power skid and the pump skid, and FIG. 17C shows a top view of the connection. As shown in FIG. 17B, the power skid 51 has a single-lug plate 510, while the pump skid 52 has a double-lug plate 520. The single-lug plate 510 is inserted into the double-lug plate 520. Pin holes of the two plates are aligned, and a pin shaft 530 is inserted into the pin holes to connect the power skid and the pump skid.

In some embodiments, the fracturing device 5 may further include an integrated skid 53. The power skid 51 and the pump skid 52 are respectively mounted on the integrated skid 53 to be fixed. In some embodiments, the power skid 51 and the pump skid 52 are detachably connected to the integrated skid 53 separately, thereby facilitating transportation.

Figure 18A:
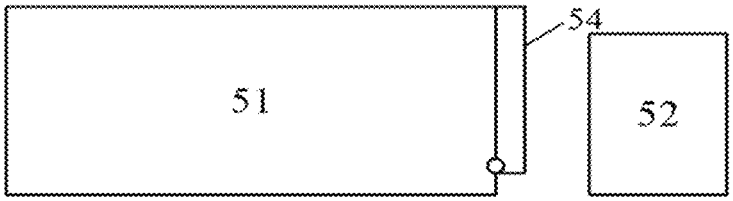
FIG. 18A and FIG. 18B are structural schematic diagrams of a fracturing device according to still other embodiments of the present disclosure.
Figure 18B:
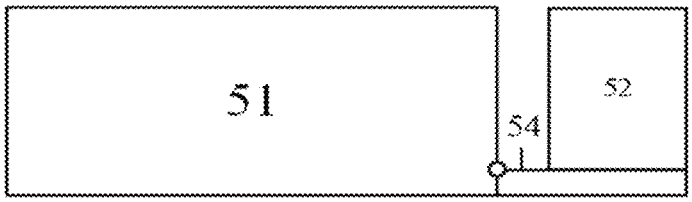

FIG. 18A and FIG. 18B are schematic diagrams of a fracturing device according to still other embodiments of the present disclosure. Unlike the embodiment shown in FIG. 17A, the power skid 51 includes a turnable mechanism 54 which is configured to be turned over to a horizontal state to carry the pump skid 52. The pump skid 52 may be detachably connected to the turnable mechanism 54. When the fracturing device is transported, the pump skid 52 may be removed and the turnable mechanism 54 may be recovered. After the arrival at the work site, the turnable mechanism 54 may be turned over to be horizontal and the pump skid 52 is mounted on the turnable mechanism 54. FIG. 18A and FIG. 18B show schematic diagrams of the turnable mechanism of the fracturing device being recovered and being working, respectively. The power skid 51 may be integrated with the muffling compartment and the turbine engine and the pump skid may be integrated with the fracturing pump. The turnable mechanism 54 may further serve to bolster the pump skid 52, so that the fracturing pump and the turbine engine are linearly arranged in the axial direction of the turbine engine, thus improving the transmission efficiency.

In at least one example, the turbine engine in the fracturing device is driven by a fuel (e.g., natural gas), while other auxiliary power systems (e.g., power for the lubricating systems, the cooling system, the cleaner, the starter, the brake mechanism, the deceleration mechanism, the heat sink and the gas pipe system) are all driven electrically. As a result, the fracturing device has the advantages of compact structure, small size and environmental protection while having high driving efficiency. In addition, the power supply pressure in the fracturing work site can be reduced.

With regard to the working principles of the present embodiment, the technical problems to be solved and the implemented technical effects, reference may be made to related description in the foregoing method embodiment, and details are not described herein again.

The basic principles of the present disclosure have been described above in conjunction with specific embodiments, but it should be noted that the advantages, superiorities, effects and the like mentioned in the present disclosure are merely exemplary and are not restrictive, and thus these advantages, superiorities, effects and the like cannot be considered to be necessary for various embodiments of the present disclosure. In addition, the specific details disclosed above are merely for the purpose of illustration and facilitating understanding, and are not restrictive, and the above details are not intended to limit the present disclosure to be implemented by using the specific details described above.

It should be noted that, relational terms such as first and second herein are merely used to distinguish one entity or operation from another entity or operation, instead of necessarily requiring or implying that any such actual relationship or order exists between these entities or operations. Moreover, the terms "include" "contain" or any other variants thereof are intended to cover non-exclusive inclusions, such that a process, a method, an article or a device, which includes a series of elements, includes not only those elements, but also other elements that are not explicitly listed, or further includes elements inherent to such a process, method, article or device. In the absence of more restrictions, an element defined by the statement "includes one" does not exclude the presence of additional identical elements in the process, method, article or device, which includes the element.

It should also be noted that, in the system and method of the present disclosure, various components or steps may be decomposed and/or recombined. Such decompositions and/or combinations should be regarded as equivalent solutions of the present disclosure.

Various embodiments in the present specification are described in a related manner, each embodiment focuses on the difference from other embodiments, and the same or similar parts between the various embodiments refer to each other. Various changes, substitutions and alterations to the techniques described herein may be made without departing from the teachings of the appended claims. Furthermore, the scope of the claims of the present disclosure is not limited to the specific aspects of compositions, means, methods and actions of the processing, machines, manufactures and events described above. It is possible to utilize compositions, means, methods or actions of the presently existing or later developed processing, machines, manufactures and events, which substantially have the same functions or substantially implement the same results as the corresponding aspects described herein. Accordingly, the appended claims include, within their scope, the compositions, means, methods or actions of such processing, machines, manufactures and events.

Finally, it should be noted that, the above descriptions are only preferred embodiments of the present disclosure and are not intended to limit the present disclosure. For those skilled in the art, the present disclosure may have various changes and modifications. Any modifications, equivalent replacements, improvements and the like, made within the spirit and principles of the present disclosure, shall all fall within the scope of the claims of the present disclosure.

What is claimed is:

1. A gas turbine overspeed protection method, comprising:

acquiring a power utilization load of a generator collected by a first sensor, and a rotating speed value, monitored by a second sensor, of a gas turbine;

judging whether the power utilization load suddenly decreases or disappears, and in response to determining that the power utilization load suddenly decreases or disappears, controlling, by a controller, an excitation current in an eddy current retarder to provide a braking torque for the generator that simulates the power utilization load;

judging whether the rotating speed value exceeds a set speed range, and in response to determining that the rotating speed value exceeds the set speed range, controlling, by the controller, the gas turbine to reduce fuel supply, and opening a discharge valve of a gas compressor to discharge a high-pressure gas to reduce a power output and the rotating speed of the gas turbine; and controlling, by the controller, the braking torque provided by the eddy current retarder to compensate for hysteresis of reducing fuel supply and opening the discharge valve in controlling a rotational speed of the gas turbine.

2. The gas turbine overspeed protection method according to claim 1, wherein after controlling, by the controller, the gas turbine to reduce fuel supply, and opening the discharge valve of the gas compressor to discharge the high-pressure gas to reduce the power output and the rotating speed of the gas turbine, the method comprises:

when a rotating speed value obtained after reducing the rotating speed of the gas turbine is not in the set speed range, reiterating: controlling, by the controller, the eddy current retarder to simulate the power utilization load to provide the braking torque for the generator; or, controlling, by the controller, the gas turbine to reduce fuel supply, and opening the discharge valve of the gas compressor to discharge the high-pressure gas to reduce the power output and the rotating speed of the gas turbine.

3. The gas turbine overspeed protection method according to claim 2, wherein after controlling, by the controller, the gas turbine to reduce fuel supply, and opening the discharge valve of the gas compressor to discharge the high-pressure gas to reduce the power output and the rotating speed of the gas turbine, the method further comprises:

when a rotating speed value obtained after reducing the speed of the gas turbine is reduced to the set speed range, sending, by the controller, an instruction to control the eddy current retarder to reduce the braking torque of the generator, and transmitting, by the second sensor, a new rotating speed value to the controller for judging, and when the new rotating speed value is stabilized within the set speed range, releasing the eddy current retarder from working; and when the new rotating speed value of the gas turbine is stabilized within the set speed range, ending the gas turbine overspeed protection method.

4. The gas turbine overspeed protection method according to claim 3, wherein after transmitting, by the second sensor, the new rotating speed value to the controller for judging, the method comprises:

when a rotating speed value obtained after reducing the braking torque of the generator do not exceed the set speed range, reiterating: sending, by the controller, the instruction to control the eddy current retarder to reduce the braking torque of the generator; and when the rotating speed value obtained after reducing the braking torque of the generator exceeds the set speed range, reiterating: controlling, by the controller, the eddy current retarder to simulate the power utilization load to provide the braking torque for the generator; or, controlling, by the controller, the gas turbine to reduce fuel supply, and opening the discharge valve of the gas compressor to discharge the high-pressure gas to reduce the power output and the rotating speed of the gas turbine.

5. The gas turbine overspeed protection method according to claim 3, wherein after the new rotating speed value is stabilized within the set speed range, and the eddy current retarder is released from working, the method comprises:

when a rotating speed value of the gas turbine after the eddy current retarder stops working is not stabilized within the set speed range, judging whether the rotating speed value of the gas turbine after the eddy current retarder stops working exceeds the set speed range;

and when the rotating speed value of the gas turbine after the eddy current retarder stops working exceeds the set speed range, reiterating: controlling, by the controller, the eddy current retarder to simulate the power utilization load to provide the braking torque for the generator; or, controlling, by the controller, the gas turbine to reduce fuel supply, and opening the discharge valve of the gas compressor to discharge the high-pressure gas to reduce the power output and the rotating speed of the gas turbine.

6. The gas turbine overspeed protection method according to claim 3, wherein after the new rotating speed value is stabilized within the set speed range, and the eddy current retarder is released from working, the method further comprises:

when a rotating speed value of the gas turbine after the eddy current retarder stops working is not stabilized within the set speed range, reiterating: controlling, by the controller, the eddy current retarder to simulate the power utilization load to provide the braking torque for the generator; or controlling, by the controller, the gas turbine to reduce fuel supply, and opening the discharge valve of the gas compressor to discharge the high-pressure gas to reduce the power output and the rotating speed of the gas turbine.

7. The gas turbine overspeed protection method according to claim 1, wherein after controlling, by the controller, the gas turbine to reduce fuel supply, and opening the discharge valve of the gas compressor to discharge the high-pressure gas to reduce the power output and the rotating speed of the gas turbine, the method further comprises:

when a rotating speed value obtained after reducing the rotating speed of the gas turbine is reduced to the set speed range, sending, by the controller, an instruction to control the eddy current retarder to reduce the braking torque of the generator, and transmitting, by the second sensor, a new rotating speed value to the controller for judging, and when the new rotating speed value is stabilized within the set speed range, releasing the eddy current retarder from working; and when the new rotating speed value of the gas turbine is stabilized within the set speed range, ending the gas turbine overspeed protection method.

8. The gas turbine overspeed protection method according to claim 7, wherein after transmitting, by the second sensor, the new rotating speed value to the controller for judging, the method comprises:

when a rotating speed value obtained after reducing the braking torque of the generator do not exceed the set speed range, reiterating: sending, by the controller, the instruction to control the eddy current retarder to reduce the braking torque of the generator; and when the rotating speed value obtained after reducing the braking torque of the generator exceeds the set speed range, reiterating: controlling, by the controller, the eddy current retarder to simulate the power utilization load to provide the braking torque for the generator; or, controlling, by the controller, the gas turbine to reduce fuel supply, and opening the discharge valve of the gas compressor to discharge the high-pressure gas to reduce the power output and the rotating speed of the gas turbine.

9. The gas turbine overspeed protection method according to claim 7, wherein after the new rotating speed value is stabilized within the set speed range, and the eddy current retarder is released from working, the method comprises:

when a rotating speed value of the gas turbine after the eddy current retarder stops working is not stabilized within the set speed range, judging whether the rotating speed value of the gas turbine after the eddy current retarder stops working exceeds the set speed range;

and when the rotating speed value of the gas turbine after the eddy current retarder stops working exceeds the set speed range, reiterating: controlling, by the controller, the eddy current retarder to simulate the power utilization load to provide the braking torque for the generator; or, controlling, by the controller, the gas turbine to reduce fuel supply, and opening the discharge valve of the gas compressor to discharge the high-pressure gas to reduce the power output and the rotating speed of the gas turbine.

10. The gas turbine overspeed protection method according to claim 7, wherein after the new rotating speed value is stabilized within the set speed range, and the eddy current retarder is released from working, the method further comprises:

when a rotating speed value of the gas turbine after the eddy current retarder stops working is not stabilized within the set speed range, reiterating: controlling, by the controller, the eddy current retarder to simulate the power utilization load to provide the braking torque for the generator; or controlling, by the controller, the gas turbine to reduce fuel supply, and opening the discharge valve of the gas compressor to discharge the high-pressure gas to reduce the power output and the rotating speed of the gas turbine.

11. The gas turbine overspeed protection method according to claim 1, further comprising:

disposing a multifunctional transmission box between the eddy current retarder and the generator, wherein the multifunctional transmission box is configured for reducing the rotating speed of the gas turbine to a rated rotating speed of the generator, and for providing a plurality of power taking ports for mounting other driving devices, wherein a hydraulic pump or a hydraulic motor is installed on the multifunctional transmission box to drive a lubricating oil cooling system and a hydraulic system.

12. An electronic device, comprising a processor and a memory, wherein:

the memory is configured to store a computer program; and the processor is configured to, when executing the program stored on the memory, implement operations comprising:

acquiring a power utilization load of a generator, which is collected by a first sensor, and a rotating speed value, monitored by a second sensor, of a gas turbine;

judging whether the power utilization load suddenly decreases or disappears, and in response to determining that the power utilization load suddenly decreases or disappears, controlling an excitation current in an eddy current retarder to provide a braking torque for the generator that simulates the power utilization load;

judging whether the rotating speed value exceeds a set speed range, and in response to determining that the rotating speed value exceeds the set speed range, controlling the gas turbine to reduce fuel supply, and opening a discharge valve of a gas compressor to discharge a high-pressure gas to reduce a power output and the rotating speed of the gas turbine; and controlling the braking torque provided by the eddy current retarder to compensate for hysteresis of reducing fuel supply and opening the discharge valve in controlling a rotational speed of the gas turbine.

13. The electronic device according to claim 12, wherein after controlling the gas turbine to reduce fuel supply, and opening the discharge valve of the gas compressor to discharge the high-pressure gas to reduce the power output and the rotating speed of the gas turbine, the operations further comprise:

when a rotating speed value obtained after reducing the rotating speed of the gas turbine is not in the set speed range, reiterating: controlling the eddy current retarder to simulate the power utilization load to provide the braking torque for the generator; or, controlling the gas turbine to reduce fuel supply, and opening the discharge valve of the gas compressor to discharge the high-pressure gas to reduce the power output and the rotating speed of the gas turbine.

14. The electronic device according to claim 12, wherein after controlling the gas turbine to reduce fuel supply, and opening the discharge valve of the gas compressor to discharge the high-pressure gas to reduce the power output and the rotating speed of the gas turbine, the operations further comprise:

when a rotating speed value obtained after reducing the rotating speed of the gas turbine is reduced to the set speed range, sending an instruction to control the eddy current retarder to reduce the braking torque of the generator, and obtaining, by the second sensor, a new rotating speed value, and when the new rotating speed value is stabilized within the set speed range, releasing the eddy current retarder from working; and when the new rotating speed value of the gas turbine is stabilized within the set speed range, ending the program.

15. The electronic device according to claim 14, wherein after obtaining, by the second sensor, the new rotating speed value, the operations further comprise:

when a rotating speed value obtained after reducing the braking torque of the generator do not exceed the set speed range, reiterating: sending the instruction to control the eddy current retarder to reduce the braking torque of the generator; and when the rotating speed value obtained after reducing the braking torque of the generator exceeds the set speed range, reiterating: controlling the eddy current retarder to simulate the power utilization load to provide the braking torque for the generator; or, controlling the gas turbine to reduce fuel supply, and opening the discharge valve of the gas compressor to discharge the high-pressure gas to reduce the power output and the rotating speed of the gas turbine.

16. A non-transitory computer-readable storage medium storing a computer program, wherein, when executed by a processor, the computer program causes the processor to perform operations comprising:

acquiring a power utilization load of a generator, which is collected by a first sensor, and a rotating speed value, monitored by a second sensor, of a gas turbine;

judging whether the power utilization load suddenly decreases or disappears, and in response to determining that the power utilization load suddenly decreases or disappears, controlling an excitation current in an eddy current retarder to provide a braking torque for the generator that simulates the power utilization load;

judging whether the rotating speed value exceeds a set speed range, and in response to determining that the rotating speed value exceeds the set speed range, controlling the gas turbine to reduce fuel supply, and opening a discharge valve of a gas compressor to discharge a high-pressure gas to reduce a power output and the rotating speed of the gas turbine; and controlling, by the controller, the braking torque provided by the eddy current retarder to compensate for hysteresis of reducing fuel supply and opening the discharge valve in controlling a rotational speed of the gas turbine.

17. The non-transitory computer-readable storage medium according to claim 16, wherein after controlling the gas turbine to reduce fuel supply, and opening the discharge valve of the gas compressor to discharge the high-pressure gas to reduce the power output and the rotating speed of the gas turbine, the operations further comprise:

when a rotating speed value obtained after reducing the rotating speed of the gas turbine is not in the set speed range, reiterating: controlling the eddy current retarder to simulate the power utilization load to provide the braking torque for the generator; or, controlling the gas turbine to reduce fuel supply, and opening the discharge valve of the gas compressor to discharge the high-pressure gas to reduce the power output and the rotating speed of the gas turbine.

18. The non-transitory computer-readable storage medium according to claim 16, wherein after controlling the gas turbine to reduce fuel supply, and opening the discharge valve of the gas compressor to discharge the high-pressure gas to reduce the power output and the rotating speed of the gas turbine, the operations further comprise:

when a rotating speed value obtained after reducing the rotating speed of the gas turbine is reduced to the set speed range, sending an instruction to control the eddy current retarder to reduce the braking torque of the generator, and obtaining, by the second sensor, a new rotating speed value, and when the new rotating speed value is stabilized within the set speed range, releasing the eddy current retarder from working; and when the new rotating speed value of the gas turbine is stabilized within the set speed range, ending the computer program.

19. The non-transitory computer-readable storage medium according to claim 18, wherein after obtaining, by the second sensor, the new rotating speed value, the operations further comprise:

when a rotating speed value obtained after reducing the braking torque of the generator do not exceed the set speed range, reiterating: sending the instruction to control the eddy current retarder to reduce the braking torque of the generator; and when the rotating speed value obtained after reducing the braking torque of the generator exceeds the set speed range, reiterating: controlling the eddy current retarder to simulate the power utilization load to provide the braking torque for the generator; or, controlling the gas turbine to reduce fuel supply, and opening the discharge valve of the gas compressor to discharge the high-pressure gas to reduce the power output and the rotating speed of the gas turbine.

* * * * *